US006062911A

United States Patent [19]

Davis et al.

[11] Patent Number: 6,062,911

[45] Date of Patent: May 16, 2000

[54] LOW PROFILE POWER CONNECTOR WITH HIGH-TEMPERATURE RESISTANCE

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 09/005,279

[22] Filed: Jan. 9, 1998

Related U.S. Application Data

[60] Provisional application No. 60/036,621, Jan. 31, 1997, provisional application No. 60/038,851, Feb. 18, 1997, and provisional application No. 60/061,000, Apr. 14, 1997.

[51] Int. Cl.[7] ..... H01R 24/00

[52] U.S. Cl. ..... 439/630; 439/79

[58] Field of Search ..... 439/629, 630, 439/79, 59, 180, 329, 746

[56] References Cited

U.S. PATENT DOCUMENTS

| | | | |
|---|---|---|---|
| 3,212,050 | 10/1965 | Stark | 439/585 |
| 3,296,363 | 1/1967 | Laudig et al. | 174/89 |
| 3,611,249 | 10/1971 | Lovrenich | 439/78 |
| 4,597,631 | 7/1986 | Flores | 385/53 |
| 4,629,281 | 12/1986 | Kruger | 439/791 |
| 4,679,888 | 7/1987 | Williams | 439/883 |
| 4,695,112 | 9/1987 | Maston et al. | 439/350 |
| 4,718,854 | 1/1988 | Capp et al. | 439/63 |
| 4,938,701 | 7/1990 | Heberling | 439/65 |
| 5,122,064 | 6/1992 | Zarreii | 439/65 |
| 5,194,017 | 3/1993 | Consoli | 439/492 |
| 5,198,279 | 3/1993 | Beinhaur et al. | 428/99 |
| 5,252,080 | 10/1993 | Pesson | 439/79 |
| 5,277,611 | 1/1994 | Berek et al. | 439/325 |
| 5,310,352 | 5/1994 | Mroczkowski et al. | 439/76 |
| 5,319,523 | 6/1994 | Ganthier et al. | 361/753 |
| 5,344,334 | 9/1994 | Labu et al. | 439/331 |
| 5,354,219 | 10/1994 | Wanjura | 439/608 |
| 5,364,280 | 11/1994 | Colleran | 439/76 |
| 5,364,287 | 11/1994 | Weber | 439/358 |
| 5,482,474 | 1/1996 | Yohn et al. | 439/79 |
| 5,493,085 | 2/1996 | Kolberg et al. | 200/51 R |
| 5,496,189 | 3/1996 | Over et al. | 439/321 |
| 5,899,759 | 5/1999 | Yeow et al. | 439/79 |

*Primary Examiner*—Steven L. Stephan
*Assistant Examiner*—Barry M. L. Standig

[57] ABSTRACT

Connector (200) for mounting to a thin circuit-bearing substrate (202) to establish electrical connections of contacts (206) with contact pads (210) of circuits on the substrate, for a high temperature environment. Connector (200) defines a low profile electrical interface of the substrate (202) with another electrical article such as a cable for power transmission. Clamp (242) is locked to housing (204) to establish sufficient clamping force to press the contacts against the contact pads (210) of the substrate after the tab (252) is inserted into a passageway defined between the clamp and the contacts (206). Bracket (228) is lockable to and about housing (204) to support and stabilize the structure of the plastic housing when subjected to high temperature.

18 Claims, 22 Drawing Sheets

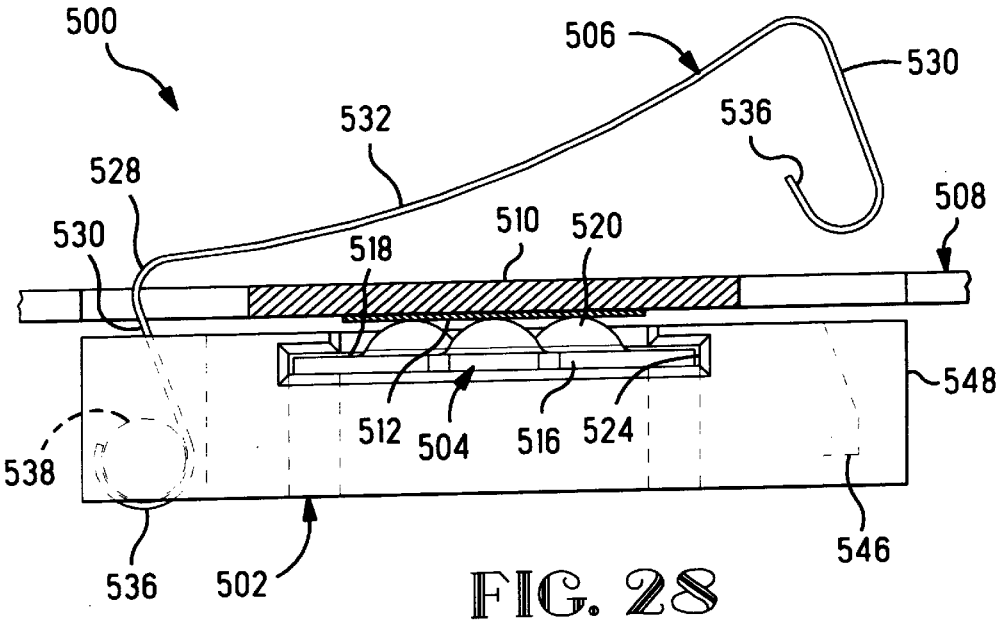
FIG. 28
FIG. 29
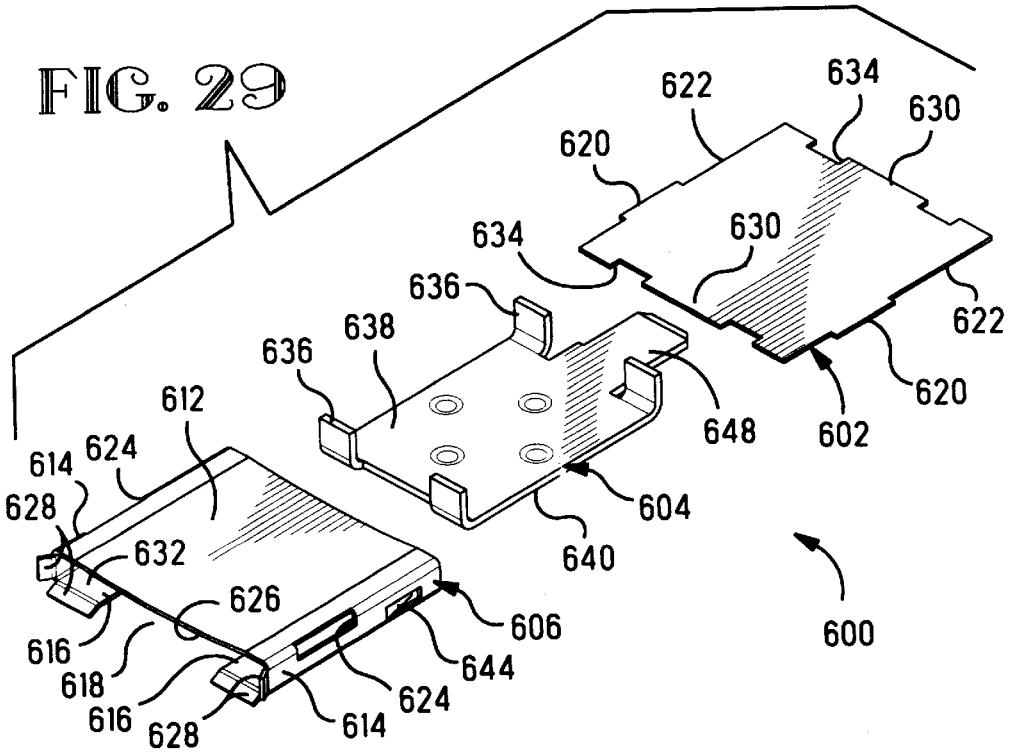

LOW PROFILE POWER CONNECTOR WITH HIGH-TEMPERATURE RESISTANCE

RELATED APPLICATION INFORMATION

This is related to Provisional applications Ser. No. 60/036,621 filed Jan. 31, 1997; Ser. No. 60/038,851 filed Feb. 18, 1997; and Ser. No. 60/061,000 filed Apr. 14, 1997.

FIELD OF THE INVENTION

This relates to electrical connectors and more particularly to connectors for electrical power transmission.

BACKGROUND OF THE INVENTION

Connectors such as for use in certain appliances must provide assured electrical connections for transmission of electrical power over long-term in-service use in environments having temperatures in the range of 200 to 350 degrees Celsius. It is desired to provide a connector mountable to a circuit-bearing substrate such as a thin ceramic-coated metal plate, where the electrical connections to circuits thereof are assured for long-term in-service use at high temperatures such as 200° C. to 350° C., to which a complementary connector is matable for transmission of electrical power such as 5 to 15 amperes.

SUMMARY OF THE INVENTION

The present invention is a connector having one or two contacts for electrical connection with respective circuits of a circuit-bearing substrate, that is easily assembled to the substrate without special tooling, and thereafter maintains an assured electrical connection of the contact or contacts with the circuit or circuits over long-term in-service use even in a high temperature environment in electrical power transmission. Openings through the substrate such as notches along edges of a substrate tab or tabs, or holes through the substrate, may be used through which portions of the connector housing or clamp are disposed for establishing the mechanical fastening of the connectors in a manner that secures the connector in position against translation and rotation. A spring section of the connector generates substantial force urging the substrate against the contact for electrical connection. The substrate may be thin ceramic-coated metal plate, or it may be a circuit board or another circuit-bearing article.

In some embodiments, a housing provides a pair of contacts for mounting to a circuit-bearing substrate at one termination site containing a pair of contact pads with which the contacts are associated. A large tab of the substrate is received into an opening between the housing and a clamp along one side of the housing, when the clamp is in a first or pretermination position, whereafter the clamp is moved toward the housing to a second or termination position and securely latched thereat, maintaining clamping force urging the large tab towards and against the contacts for circuit pads to be electrically connected to contact surfaces of the contacts. A bracket may be used along the opposed side of the housing from the clamp, and the clamp may lockingly engage the bracket at ends of the housing. In one embodiment of connector, the insulative housing provides discrete protective sections that optimize the prevention of inadvertent and undesirable contact between conductive portions of the connector assembly, the circuit-bearing substrate and the mating contacts.

In other embodiments, a pair of single-contact connectors provide an electrical interface of the circuits of the substrate for external connection. Substantial compressive force generated by the housing and a spring section of the connector onto the contact surface and the substrate's contact pad, establishes assured connection of the contact or contacts of the connectors. The fastening means may be a bolt or a clamp member, and the spring may be defined by the clamp member. The connector housing secures the contact in position spaced from any conductive portions of the substrate or items external of the substrate, and the housing may be of dielectric material, or may include a non-conductive component to isolate the contact and the contact pad of the substrate from a metallic clamping member of the connector assembly.

It is an objective to provide a connector preassembled as a unit, easily securable to a prepared portion of a substrate without special tools, whereby electrical connections are defined with circuits of the substrate, sufficient to withstand high temperatures for power transmission.

It is another objective that the electrical paths be isolated against incidental conductive contact.

It is yet another objective that the connector define a low profile.

It is still another objective that the contact be pressed against the contact pad of the substrate under substantial force for long-term in-service use of the connector under high temperature conditions, to assure the electrical connection sufficient for transmission of electrical energy at power levels.

It is additionally an objective to provide a rigid support around the housing so that the housing may be fabricated of inexpensive thermoplastic material and yet have its shape maintained during long-term exposure to high temperatures, to maintain the necessary pressure between the contacts and the substrate contact pads.

Embodiments of the present invention will now be described by way of example with reference to the accompanying drawings.

BRIEF DESCRIPTION OF THE INVENTION

FIG. 28 is a cross-sectional view of the connector of FIGS. 25 and 26 being clamped to the circuit-bearing sheet of FIG. 27;

FIGS. 29 and 30 are exploded and assembled isometric views of a sixth embodiment of the present invention;

DETAILED DESCRIPTION

Figure 1:
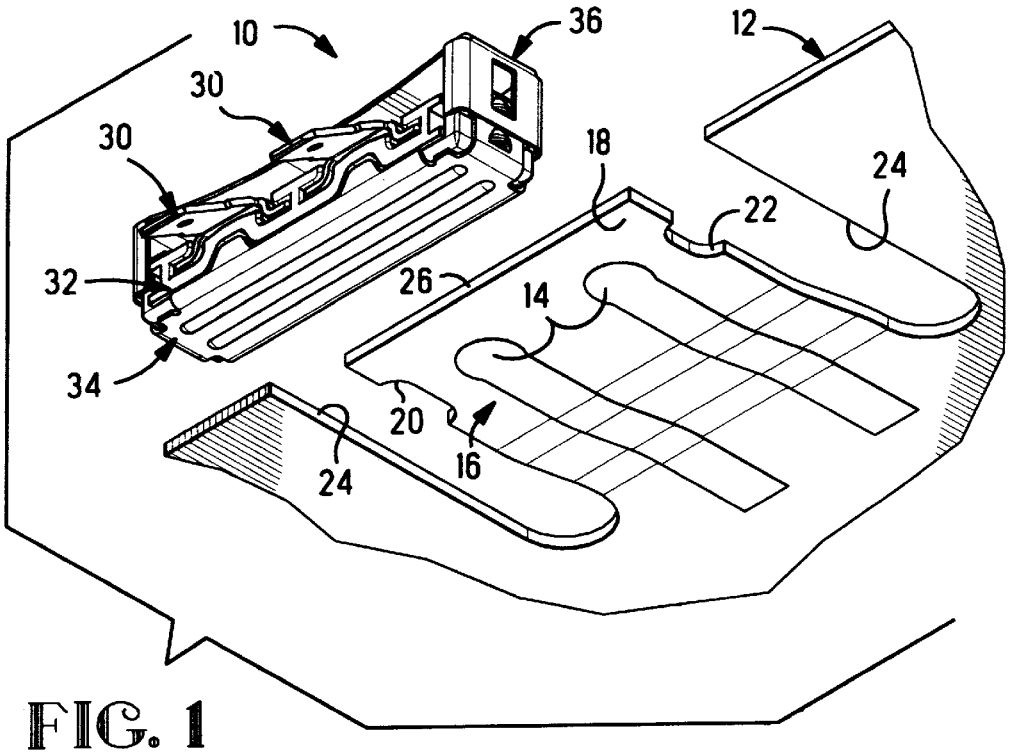
FIGS. 1 and 2 are isometric bottom and top views respectively of a first embodiment of connector having two contacts for respective contact pads of a circuit-bearing substrate.
Figure 2:
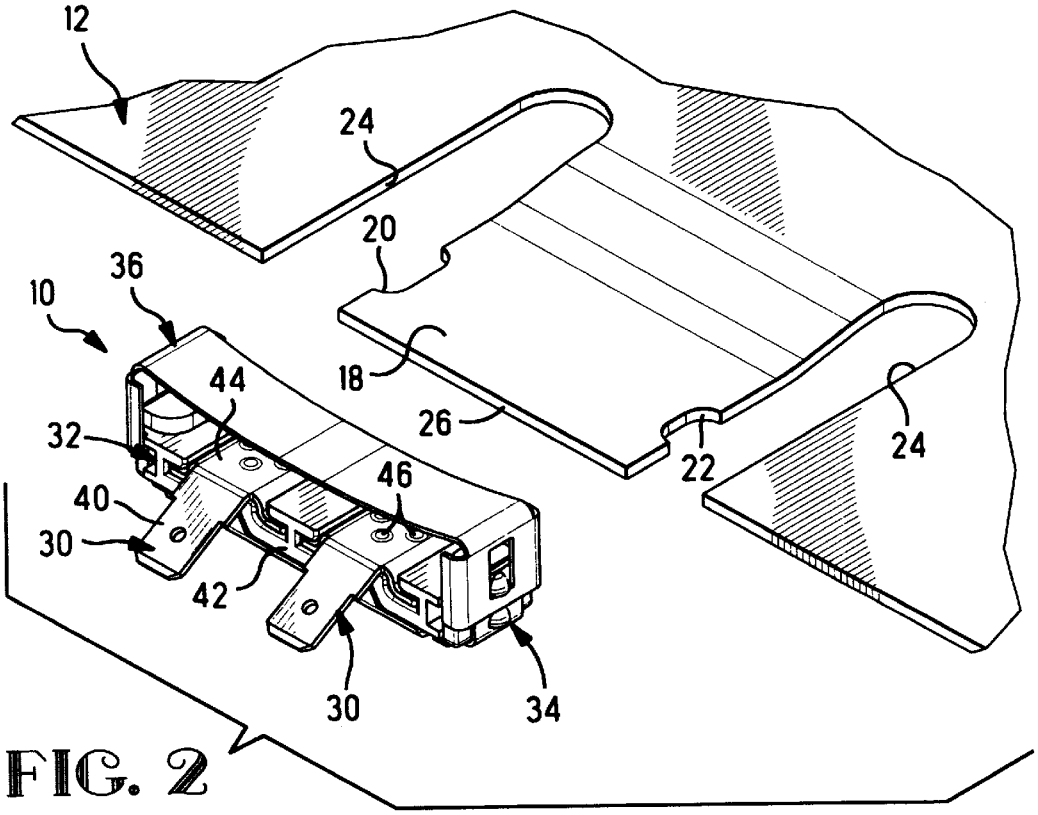

The present invention is a connector applicable to a circuit-bearing substrate for termination of contact pads of the circuits thereon. Each of the embodiments disclosed is useful with a respective embodiment of such circuit-bearing substrate as shown in the FIGURES.

FIGS. 1 to 9 are illustrative of a first embodiment of connector, and FIGS. 10 to 17 of a second embodiment.

Connector 10 is useful for termination to an associated embodiment of a substrate or plate 12 having circuits defined thereon each having a contact pad 14 (FIG. 1) exposed at a termination site 16. Connector 10 is adapted to be affixed mechanically to the plate and establish electrical connections with the respective circuits. Substrate 12 may be for example a thin, rigid ceramic-coated metal plate for use as a heating element in an appliance such as a stove, and the circuits may be silver traces defined on the surface of the ceramic material.

A pair of contacts 30 is disposed within a housing 32 of dielectric material, associated with respective ones of a pair of circuits of the substrate for power transmission, and a bracket 34 and a clamp member 36 are securable to and about the dielectric housing Each contact 30 includes a body section 38 secured within housing 32 and a contact section 40 extending from the connector along a mating face 42 for electrical connection to a complementary contact section of another electrical article such as a cable (not shown). The contact section may be tab-shaped, and the complementary contact section may be a female terminal such as a 250 Series FASTON Receptacle sold by AMP Incorporated, Harrisburg, Pa. such as under Part No. 170213. A contact surface 44 is defined on contact 30 and is exposed within connector 10 for electrical connection to a respective contact pad 14 of substrate 12, preferably including a plurality of embossments 46 to establish a plurality of electrical connection sites engageable with contact pad 14.

Figure 4:
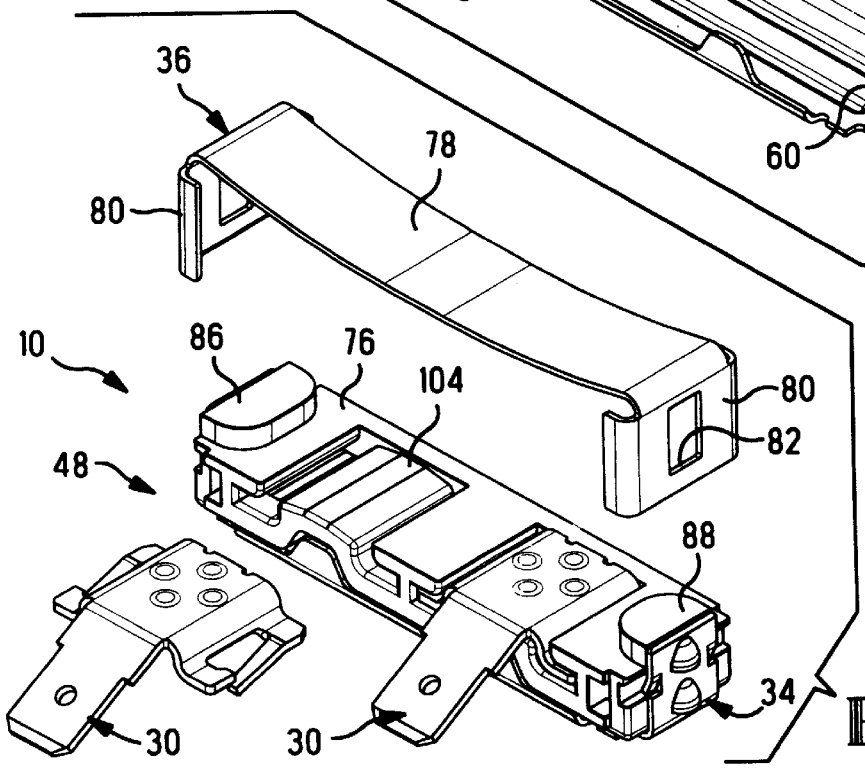
FIGS. 4 and 5 are isometric views of the connector of FIGS. 1 to 3 partially and fully assembled respectively to a pretermination arrangement.
Figure 5:
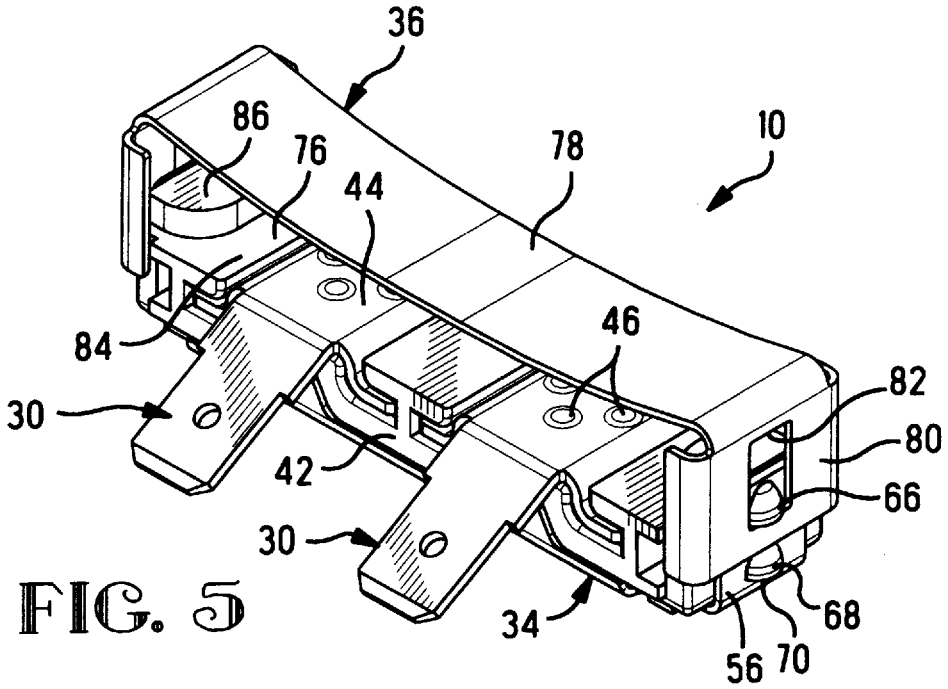

In FIG. 4, bracket 34 has been locked to housing 32 to define a subassembly 48. Bracket 34 includes a transverse body section 50 associated with outer surface 52 of housing 32, opposed upturned end portions 54 associated with mating face 42 and the rearward face of housing 32, and opposed side arms 56 associated with respective side surfaces 58 of housing 32. Each side arm 56 includes preferably a pair of locking lances 60 protruding inwardly and toward body section 50, so that the ends thereof are lockable onto ledge 62 in groove 64 along side surfaces 58 of housing 32 such that body section 52 is disposed along and against outer surface 54 of housing 32. Upturned end portions 54 assure that housing 32 is secured against relative movement with respect to bracket 34. Body section 50 will rigidly support housing 32 during in-service use under high temperature, and preferably includes strength ribs enhancing the ability to perform that function.

Each side arm 56 also includes first and second protrusions 66,68 struck outwardly to define respective latching surfaces 70 facing toward body section 50 and spaced along side arm 56 to its end edge 72, with each protrusion having a curved inclined camming surface 74 proceeding toward latching surface 70 thereof. First projections 66 are positioned at a level proximate substrate-proximate surface 76 of housing 32, while second projections 68 are positioned relatively remote from substrate-proximate surface 76 (see FIG. 4), the latch projections thus being staggered along side arms 56 to define sequential first and second latched positions for clamp member 36 associated with pretermination and mounted positions of connector 10.

In FIGS. 1, 2, 5 and 6, clamp member 36 is secured to the subassembly 48 of housing 32 and bracket 34 in a first position such that connector 10 is shown in a pretermination condition, whereby the connector is movable as a unit to facilitate handling. Clamp member 36 includes a transverse body section 78 and side walls 80 extending from the ends thereof. Each side wall 80 includes a latch-receiving aperture 82 therethrough, associated with first and second protrusions 66,68 of bracket 34. In the pretermination position, clamp member 36 is latched onto first protrusions 66 SO that a substrate-receiving opening 84 is defined between body section 78 and substrate-proximate surface 76 of housing 32 and contact surfaces 44 of contacts 30. Upstanding flanges 86,88 of housing 32 rise above substrate-proximate surface 76 at lateral sides of opening 84 to be seated in cutouts 20,22 of large tab 18 of substrate 12 at which termination site 16 is defined, providing retention of connector 10 onto large tab 18 after mounting thereto, resistant to stresses during unmating tending to pull connector 10 from substrate 12. Flanges 86,88 are preferably of different sizes and/or shapes with cutouts 20,22 being correspondingly sized and/or shaped, providing polarization to assure appropriate orientation of connector 10 on substrate 12. Slots 24 coextend from leading edge 26 of large tab 18, and large tab 18 may be angled slightly to be offset from the plane of substrate 12. Side walls 80 of clamp member 36 coextend from body section 78 and pass through slots 24 to be latched to subassembly 48 for mounting of connector to the substrate.

Figure 6:
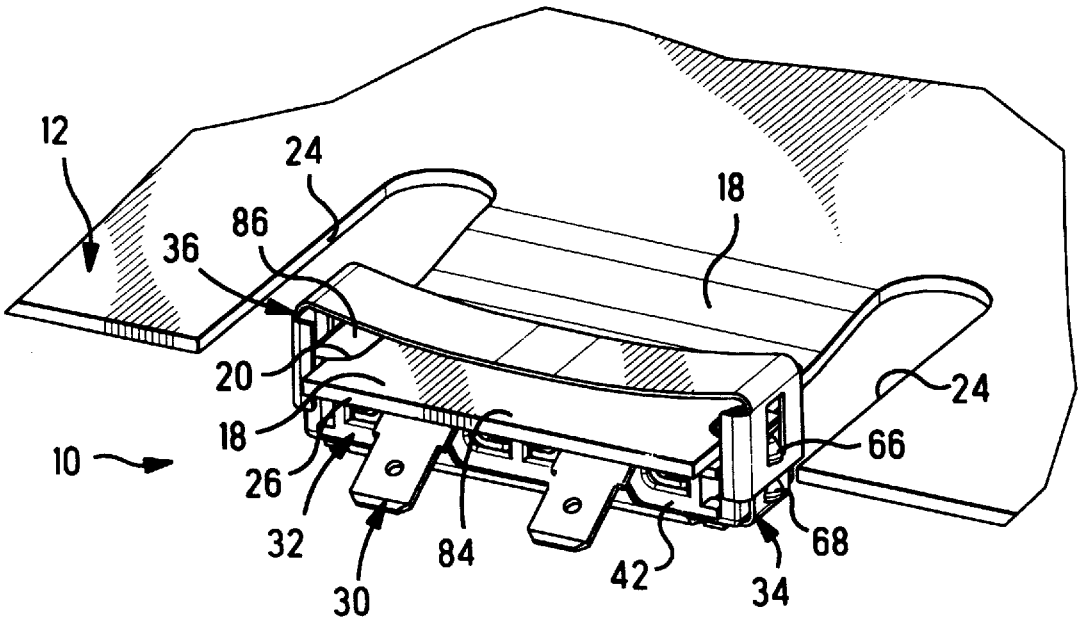
FIG. 6 is an isometric view of the assembled connector of FIG. 5 positioned for termination to the substrate of FIG. 1.

When clamp member 36 is in the pretermination position (FIG. 8), body section 78 is spaced above flanges 86,88 permitting leading edge 26 of large tab 18 to be inserted into opening 84 above flanges 86,88 whereafter the flanges are seated in cutouts 20,22 (FIG. 6). Second protrusions 68 are abutted by the ends of side walls 80 to prevent inadvertent movement of clamp member 36 toward housing 32, thereby maintaining the substrate-receiving opening 84. Clamp 36 is then urged toward large tab 18 and housing 32 to become clamped into the mounted position (FIG. 9) by entering into latched engagement with second latch protrusions 68.

Figure 3:
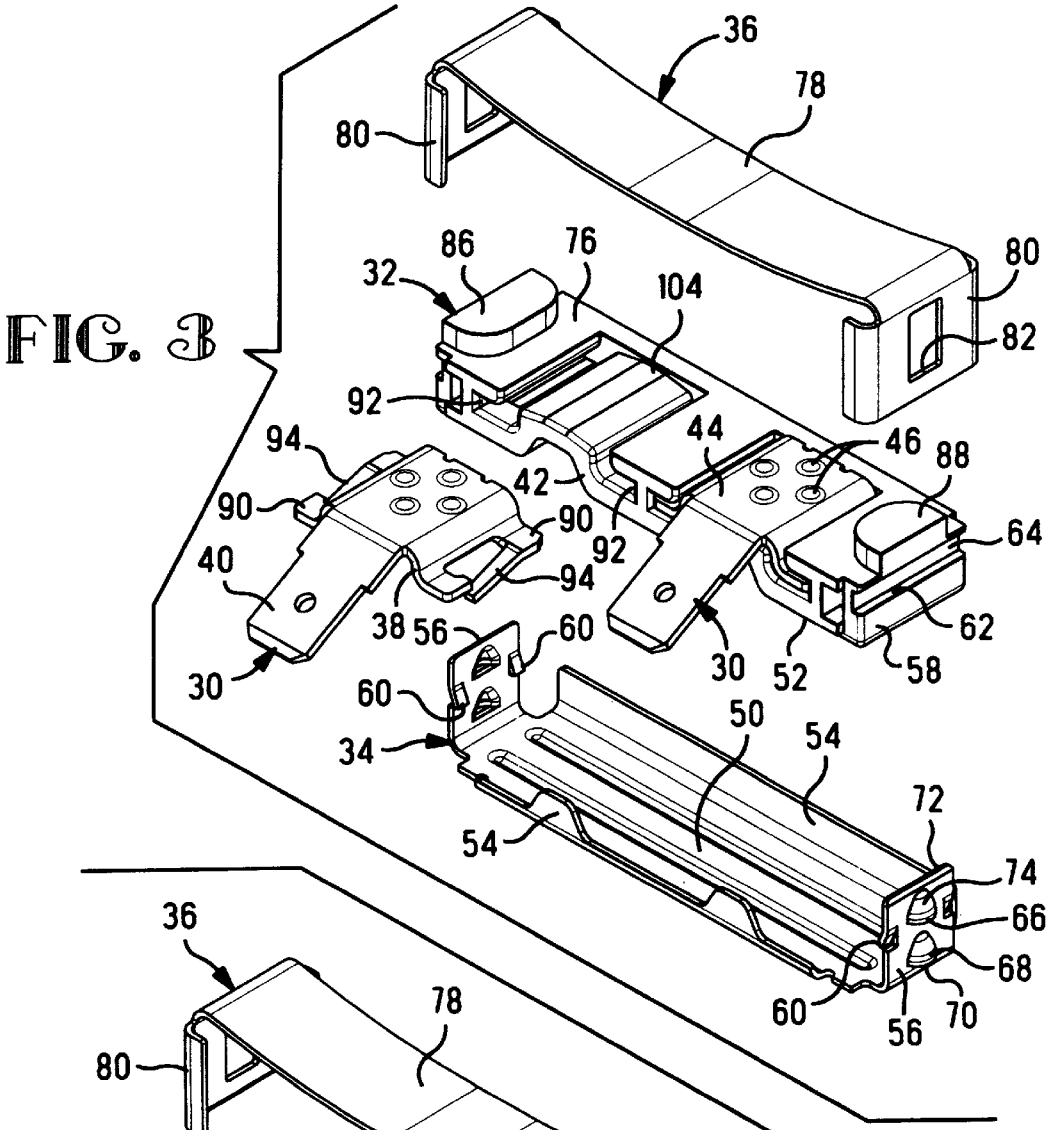
FIG. 3 is an exploded isometric view of the connector of FIGS. 1 and 2.
Figure 7:
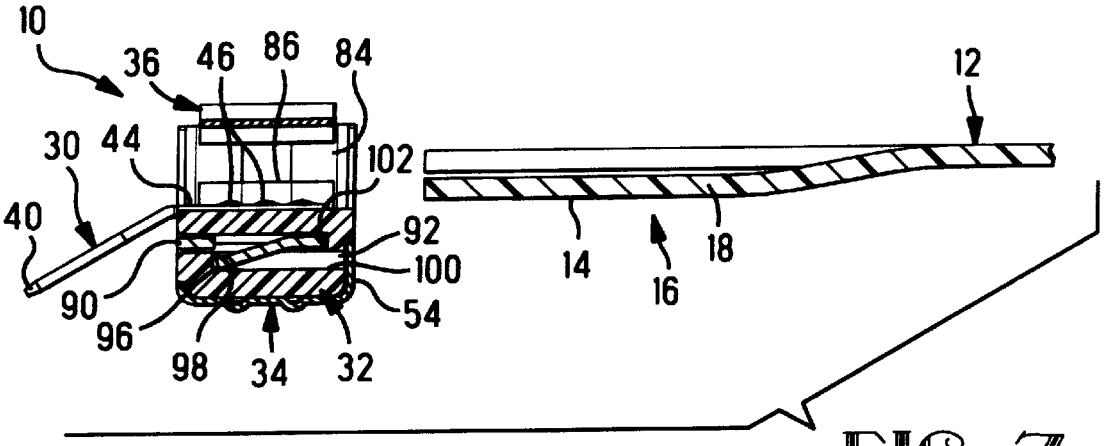
FIG. 7 is a longitudinal section view of the connector of FIGS. 1 to 6 positioned to be assembled to the substrate of FIGS. 1 and 2.
Figure 8:
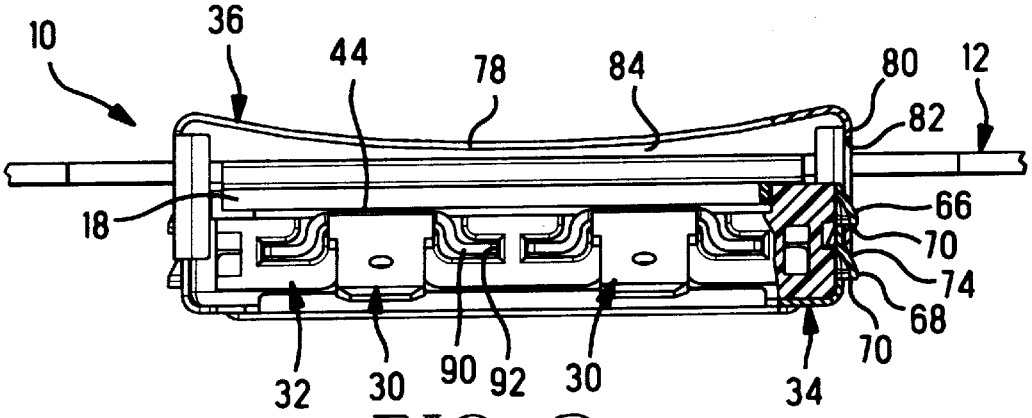
FIGS. 8 and 9 are elevation views of the connector of FIGS. 1 to 7 before and after being clamped to the circuit-bearing substrate.

Referring particularly to FIGS. 3 and 7, contacts 30 each include wings 90 extending from body section 38 along lateral sides thereof that are offset from the plane of body section 38 below contact surface 44 of contact 30. Wings 90 are associated with slots 92 extending into housing 32 from mating face 42, and are insertable thereinto as contact 30 is urged into housing 32 from mating face 42 during connector assembly. Retention lances 94 are formed along wings 90 and extend to free ends 96 engageable against stop surfaces 98 at forward ends of recesses 100 into bottom surfaces of slots 92, the stop surfaces facing away from mating face 42, such that lances 94 snap into recesses 100 to define contact retention along with slot rearward ends 102. Slots 92 are in communication with substrate-proximate surface 76, and between slots 92 is a contact-supporting surface 104.

Figure 9:
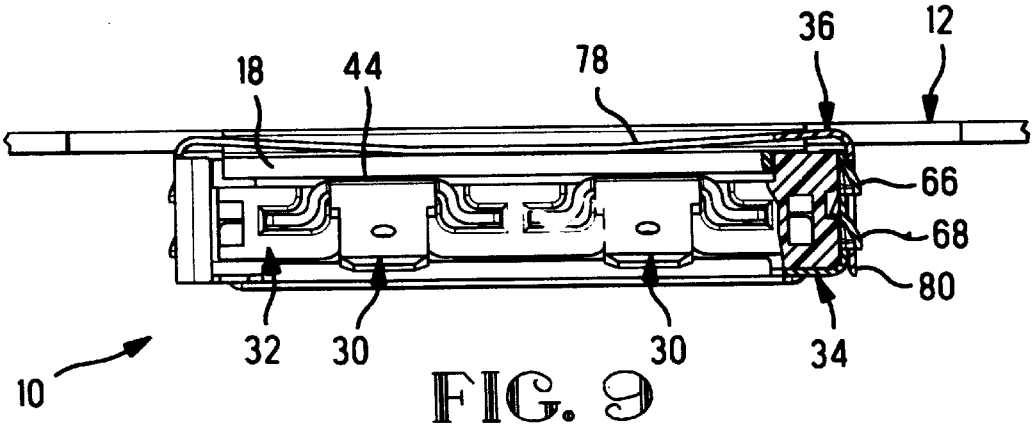

Both bracket 34 and clamp member 36 preferably are stiffly resilient, such as being formed from stainless steel, with body section 78 of clamp member 36 being convex toward substrate-proximate surface 76 of housing 32 such that contact pads 14 on large tab 18 are clamped under significant force against embossments 46 of contact surfaces 44 of respective preferably brass contacts 30 supported by contact-support surfaces 104 (FIG. 9). Connector 10 defines assured electrical power connections with circuits of substrate 12 upon connector 10 being fully mounted thereto, when subjected to high temperatures during in-service use. Connector 10 is also easily applied to substrate 12 without tools, is easily removable if desired for repair and replacement, has a low profile, is electrically isolated from other conductive portions of substrate 12 with clamp member 36 being isolated from contacts 30 and circuit pads 14, and resistant to stress during mating and unmating and to vibration and temperature cycling.

For high temperature applications in the 200° C. range, the material of the dielectric housing may be a high-temperature thermoplastic material such as, for example, XYDAR liquid crystal polymer resin sold by Amoco Performance Products, Atlanta, Ga. The use of bracket 34 and clamp 36 assuredly support the plastic housing when subjected to high temperatures for long-term in-service use. Also useful to form the housing is a thermoset material such as DAP resin having Part No. 221-VO200 sold by Rogers Corporation; ceramic material will perform well, as well, especially at higher-end temperatures of about 350 degrees Celsius.

FIGS. 10 to 17 show a second embodiment of connector 200 for termination to a circuit bearing substrate 202. The components of connector 200 and its application to the substrate are somewhat similar to those of connector 10 of FIGS. 1 to 9, and the differences therefrom will now be described.

Housing 204 is adapted to receive thereinto contacts 206 that have body sections 208 and contact sections 210 coextending in parallel from a side wall 212. Body sections 208 are received into respective slots 214 in housing 204 from mating face 216 thereof, with side walls 212 received into slot portions 218 extending orthogonally from slots 214 to substrate-proximate surface 220 of housing 204, and contact sections 210 are disposed in recesses 222 along substrate-proximate surface 220. Body sections 208 include retention lances 224 latching behind rearwardly facing ledges along slots 214 after full contact insertion into housing 204. It is seen that contacts 206 are stamped and formed from metal stock that is thinner than the stock of contacts 30 of connector 10, which reduces cost and enables forming a more resilient retention lance 224 to facilitate assembly of contacts 206 into housing 204. Tab-shaped contact sections 226 are formed from doubled-over portions of the blank to attain a sufficient cross-sectional area. The design of contacts 206 enable closer centerline spacing than that of contacts 30 of connector 10.

Figure 10:
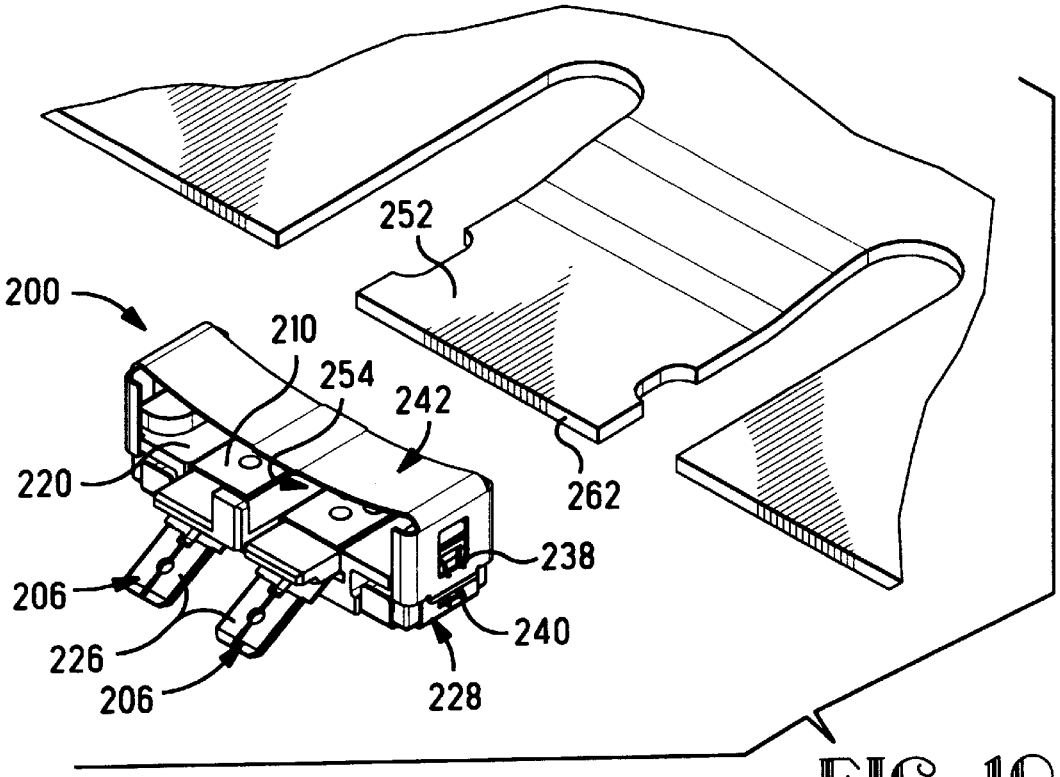
FIG. 10 is an isometric view of a second embodiment of connector positioned to be applied to a circuit bearing substrate.
Figure 12:
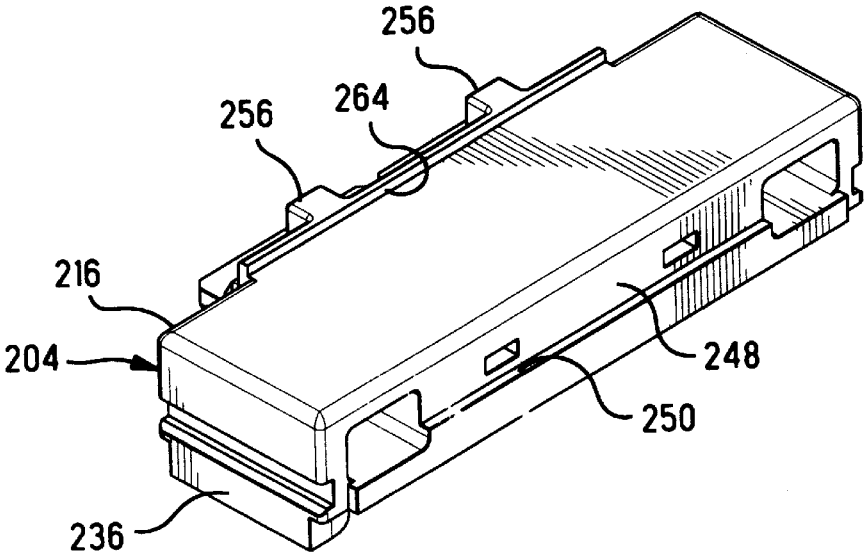
FIGS. 12 and 13 are isometric views of the housing of the connector of FIGS. 10 and 11 from rearwardly and from below forwardly, respectively.
Figure 11:
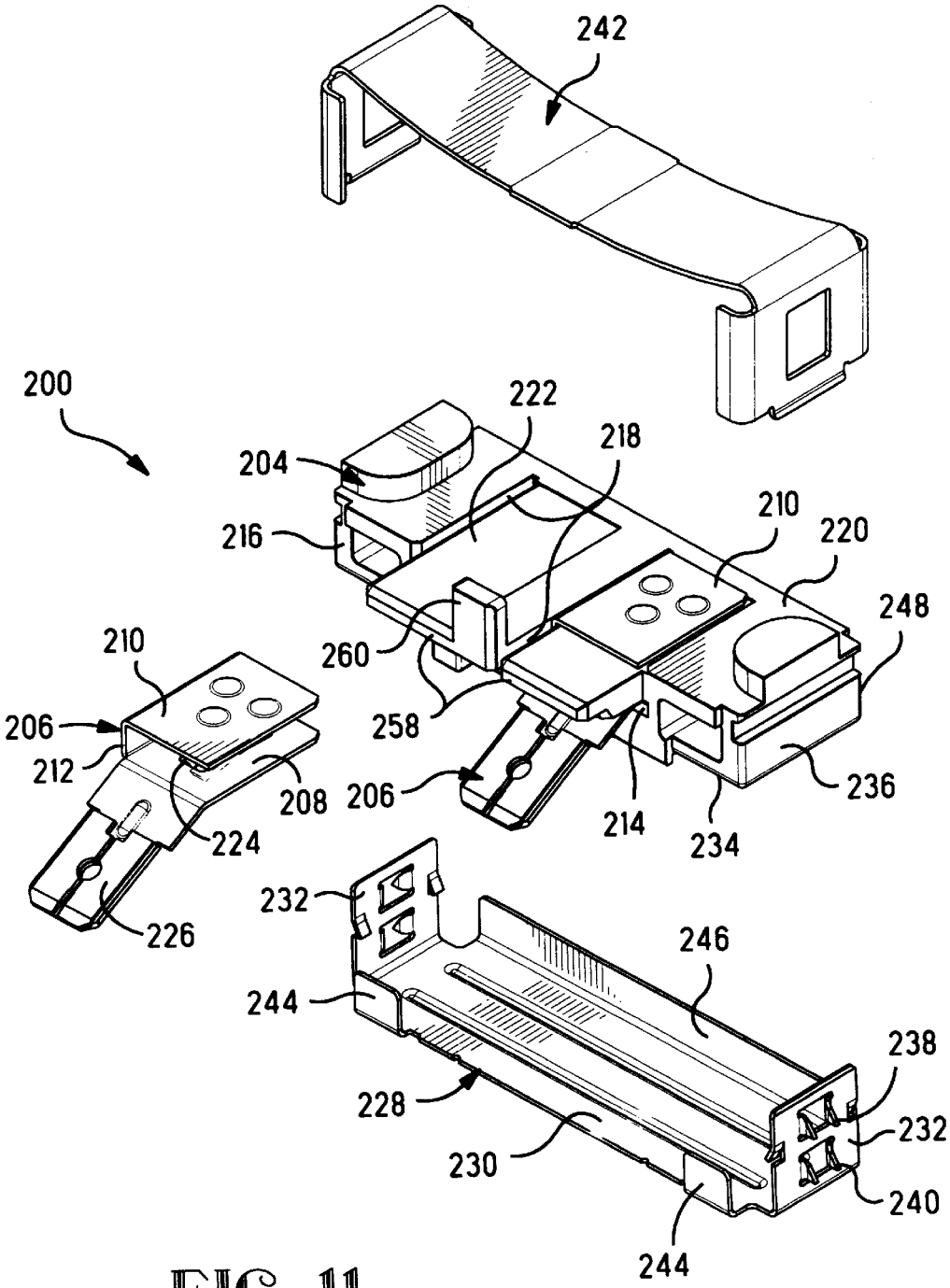
FIG. 11 is an exploded isometric view of the connector of FIG. 10.
Figure 13:
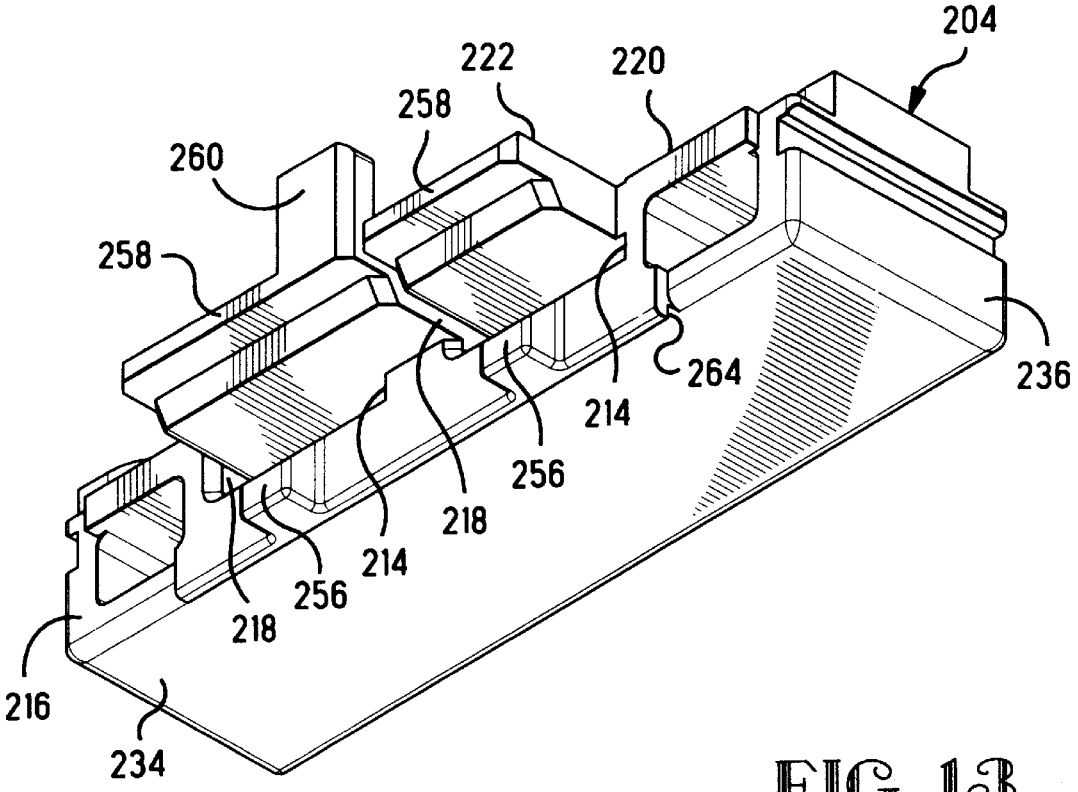
Figure 14:
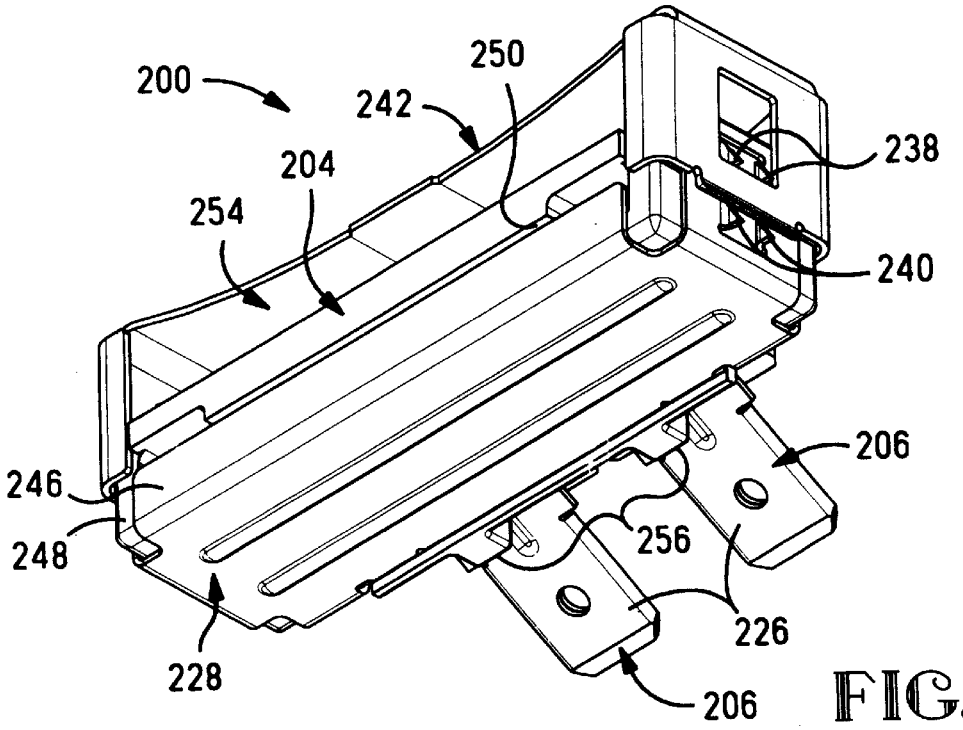
FIG. 14 is an isometric view of the connector of FIGS. 10 and 11 from below rearwardly.
Figure 15:
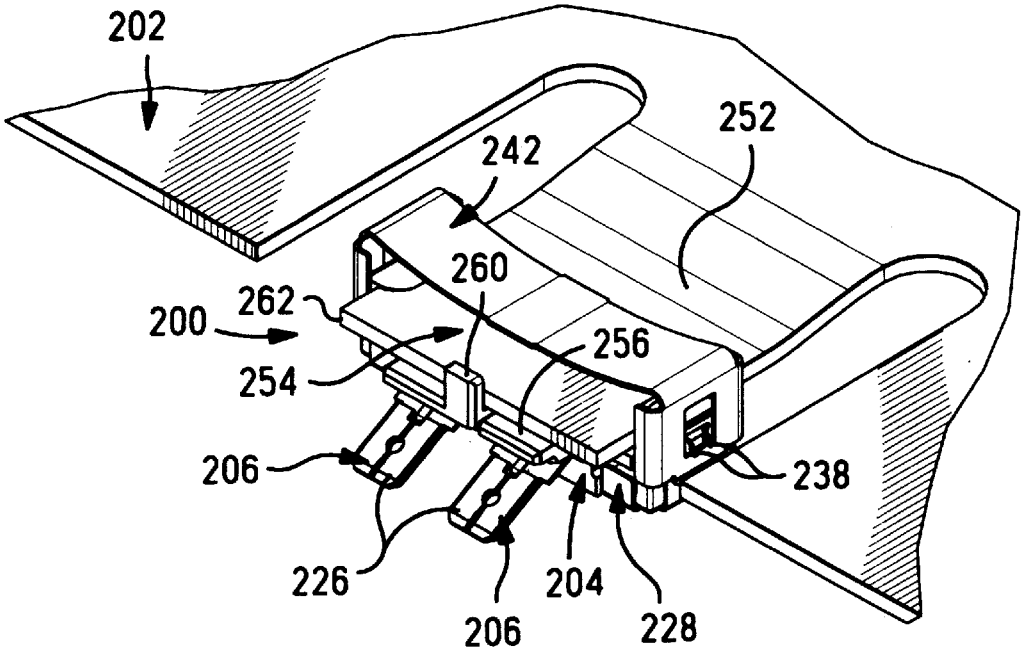
FIGS. 15 and 16 are isometric views of the connector of FIG. 10 positioned on and terminated to the substrate, respectively.
Figure 16:
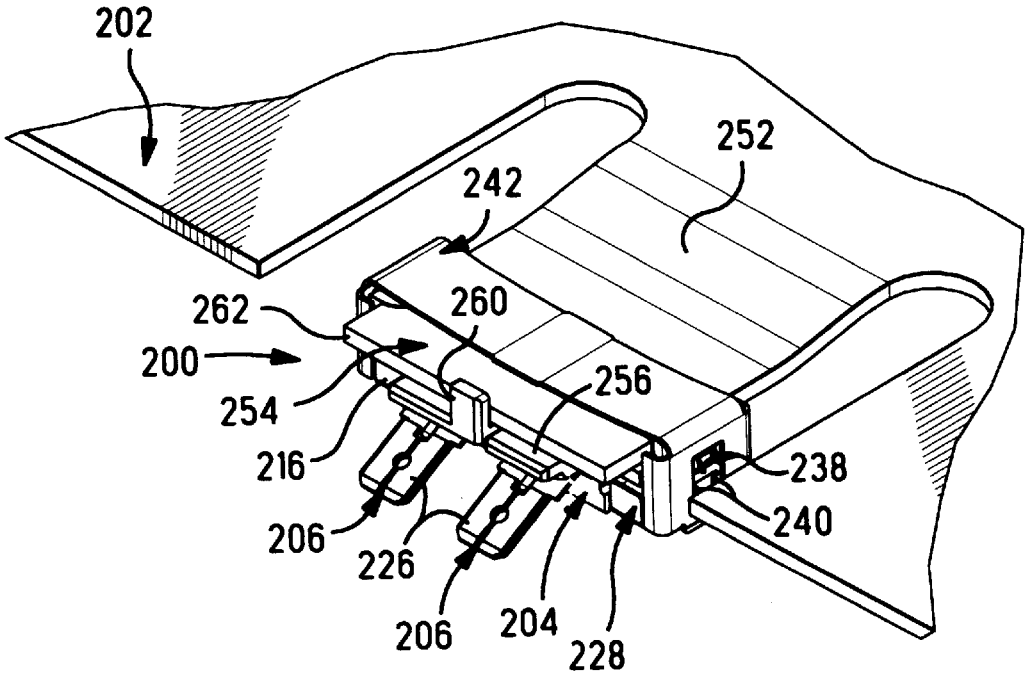
Figure 17:
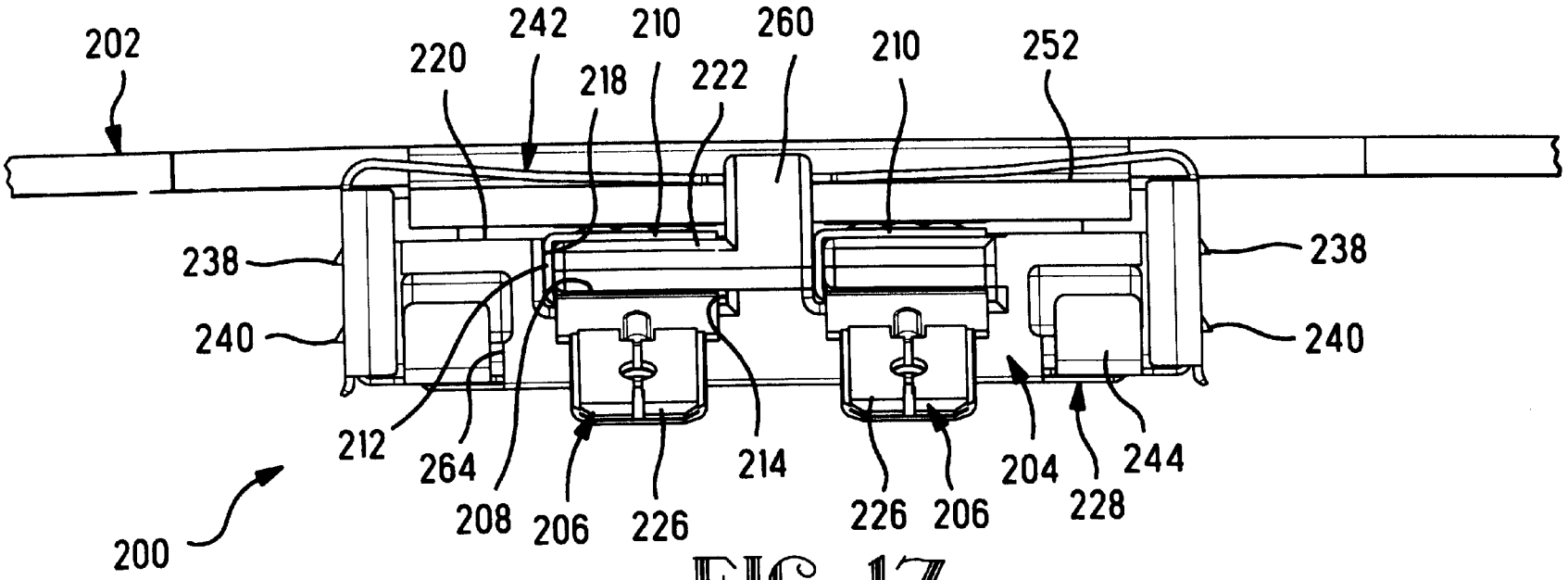
FIG. 17 is an elevation view of the connector of FIG. 16 after termination to the substrate.

Bracket 228 includes a body section 230 and opposed side arms 232 that are associated with bottom surface 234 and side walls 236 of housing 204, respectively. A pair of first protrusions 238 and a pair of second protrusions 240 define preterminated and terminated positions for clamp member 242. FIGS. 10, 14 and 15 depict the preterminated position of clamp member 242, while FIGS. 16 and 17 illustrate the terminated position. Upstanding tabs 244 are formed at ends of the forward edge of body section 230 and will be disposed recessed along mating face 216 of housing 204, while a rearward wall section 246 will extend along rear housing wall 248.

The protective features of connector 200 will now be described. Ledge 250 of housing 204 extends along rear housing wall 248 between rearward wall section 246 of bracket 228 (see FIG. 14) and tab 252 of circuit bearing substrate 202 received into tab-receiving opening 254 after termination of connector 200 thereto, for assured insulation of tab 252 from bracket 228. Embossments 256 extend forwardly from housing 204 along lower surfaces of tab-shaped contact sections 226 of contacts 206 (see FIG. 14), and serve to support the sections against being deflected into engagement with a forward edge of bracket 228. Flanges 258 of housing 204 extend forwardly from housing 204 above tab-shaped contact sections 226 (FIG. 13) to assure against any contact between tab-shaped contact sections 226 or mating contact sections (not shown) mated therewith and either substrate tab portion 252 or clamp member 242. Upstanding boss 260 extends upwardly at leading ends of flanges 258, defining a positive forward stop for leading edge 262 of substrate tab portion 252 (see FIGS. 15 to 17) upon insertion into tab-receiving opening 254. A lip 264 of housing 204 (best seen in FIGS. 12, 13 and 17) depends from mating face 216 just forwardly of the forward edge of bracket 228 to further insulate bracket 228 from possible contact with tab-shaped contact sections 226 or mating contact sections mated therewith.

Figure 18:
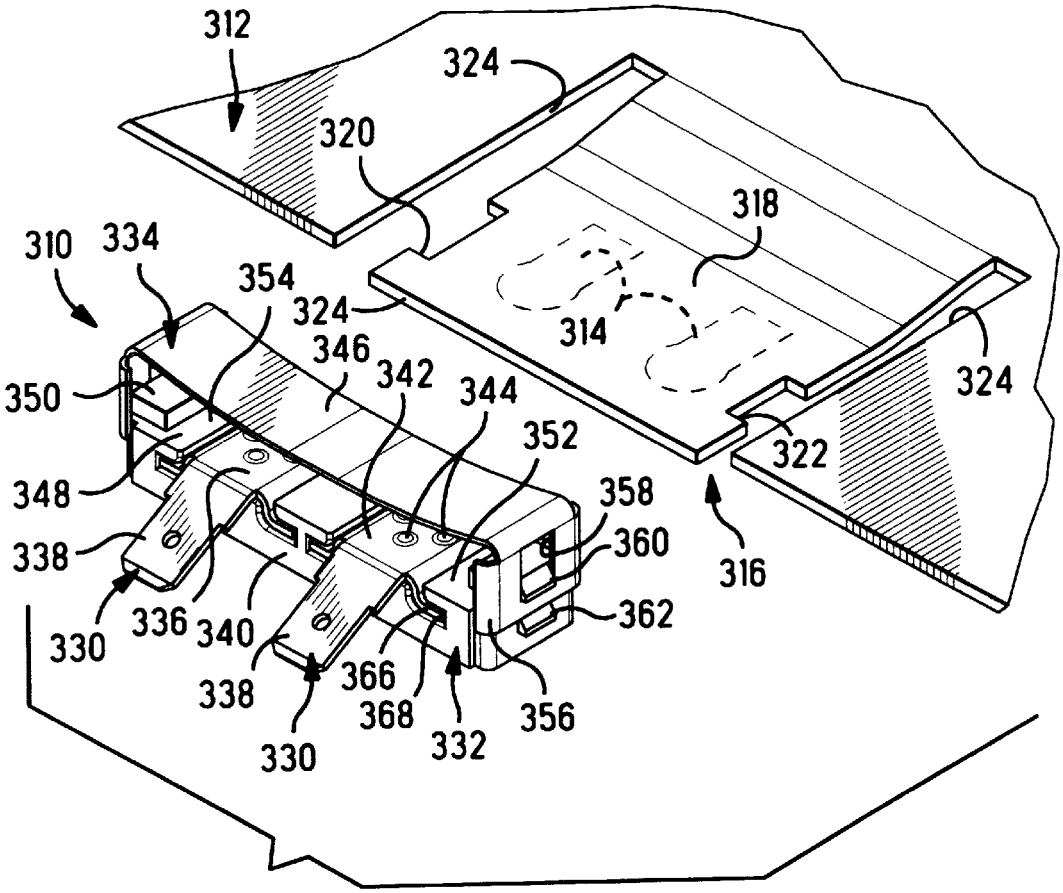
FIGS. 18 and 19 are isometric assembled and exploded views of a third embodiment of connector having two contacts for respective contact pads of a circuit-bearing sheet.
Figure 20:
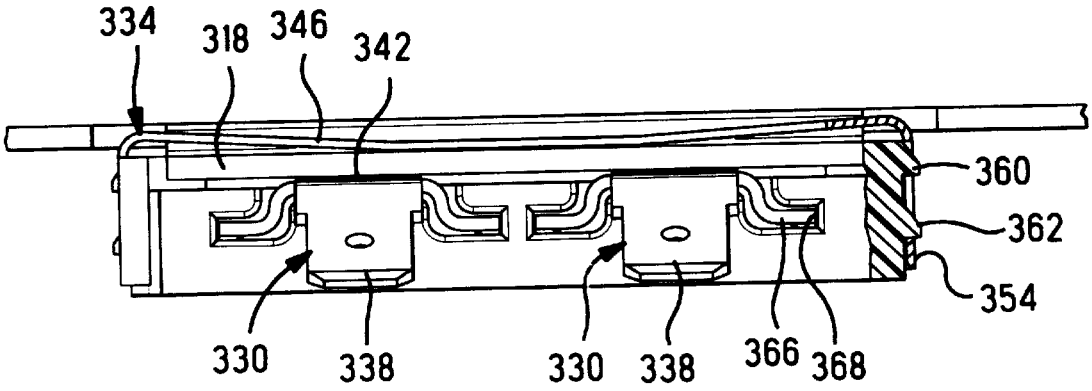
FIG. 20 is an elevation view of the connector of FIG. 18 before and after being clamped to the circuit-bearing sheet.
Figure 19:
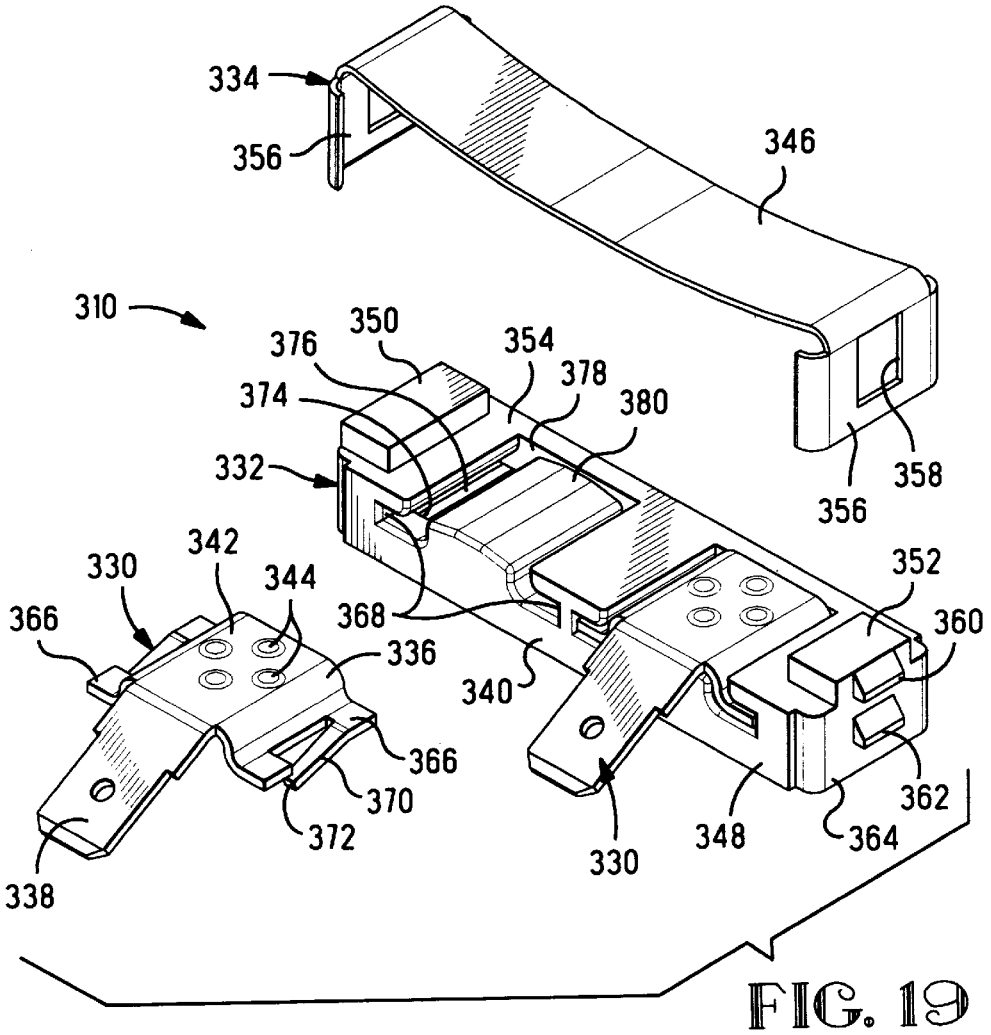

FIGS. 18 to 20 disclose a third embodiment of connector 310 for termination to an associated embodiment of a substrate 312 having circuits defined thereon each having a contact pad 314 exposed at a termination site 316 and shown in phantom in FIG. 18. A pair of contacts 330 is disposed within housing 332, and a clamp member 334 is securable to the housing. Each contact 330 includes a body section 336 secured within housing 332 and a contact section 338 extending from the connector along mating face 340. A contact surface 342 is defined on contact 330 and is exposed within connector 310 for electrical connection to a respective contact pad 314 of substrate 312, preferably including a plurality of embossments 344.

In FIG. 18, connector 310 is shown in a pretermination condition wherein clamp member 334 is latched to housing 332 in a first position with clamp body section 346 spaced from housing 332 and contact surfaces 342 to define a substrate-receiving recess 348. Upstanding flanges 350,352 of housing 332 rise above substrate-proximate surface 354 at lateral sides of recess 348, to be seated in cutouts 320,322 of large tab 318 of substrate 312 at which termination site 316 is defined. As with the connectors of FIGS. 1 to 17, flanges 350,352 are preferably of different sizes and/or shapes with cutouts 320,322 for polarization. Slots 324 coextend from leading edge 326 of large tab 318, and large tab 318 may be angled slightly to be offset from the plane of substrate 312. Side walls 356 coextend from body section 346 of clamp 334 and pass through slots 324 to be latched to housing 332 for mounting of connector 310 to the substrate.

Referring to FIG. 19, side walls 356 include latch-receiving apertures 358 therethrough, associated with a pair of latch projections 360,362 formed on side walls 364 of housing 332. First projections 360 are positioned at a level proximate substrate-proximate surface 354, while second projections 362 are positioned relatively remote from substrate-proximate surface 354, the latch projections thus being staggered along side walls 356 to define sequential first and second latched positions for clamp 334 associated with pretermination and mounted positions of connector 310. When clamp 334 is in the pretermination position, body sections 346 are spaced above flanges 350, 352 permitting leading edge 326 of large tab 318 to be inserted into opening 348 (FIG. 18) above flanges 350,352 whereafter the flanges are seated in cutouts 320,322. Clamp 334 is then urged toward large tab 318 and housing 332 to become clamped into the mounted position (FIG. 20) by entering into latched engagement with second latch projections 362.

Best seen in FIG. 19, contacts 330 each include wings 366 extending from body section 336 along lateral sides thereof that are offset from the plane of body section 336 below substrate-engaging surface 342 of contact 330. Wings 366 are associated with slots 368 extending into housing 332 from mating face 340, and are insertable thereinto as contact 330 is urged into housing 332 from mating face 340 during connector assembly. Retention lances 370 are formed along wings 366 and extend to free ends 372 engageable against stop surfaces 374 at forward ends of recesses 376 into bottom surfaces of slots 368, the stop surfaces facing away from mating face 340, such that lances 370 snap into recesses 376 to define contact retention along with slot rearward ends 378. Slots 368 are in communication with substrate-proximate surface 354, and between slots 368 is a contact-supporting surface 380.

Figure 22:
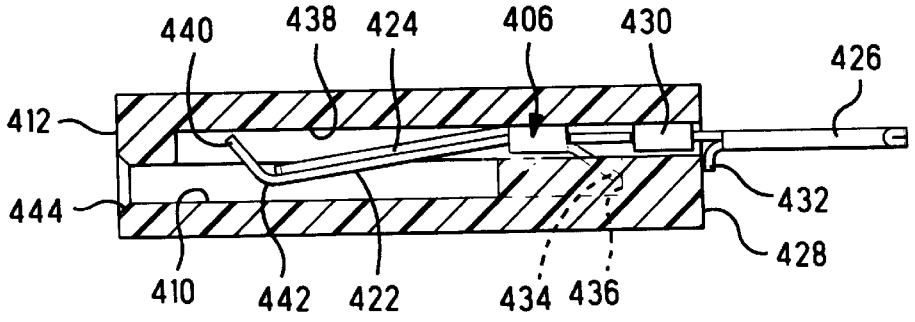
FIG. 22 is a longitudinal section view of the connector of FIG. 21.
Figure 21:
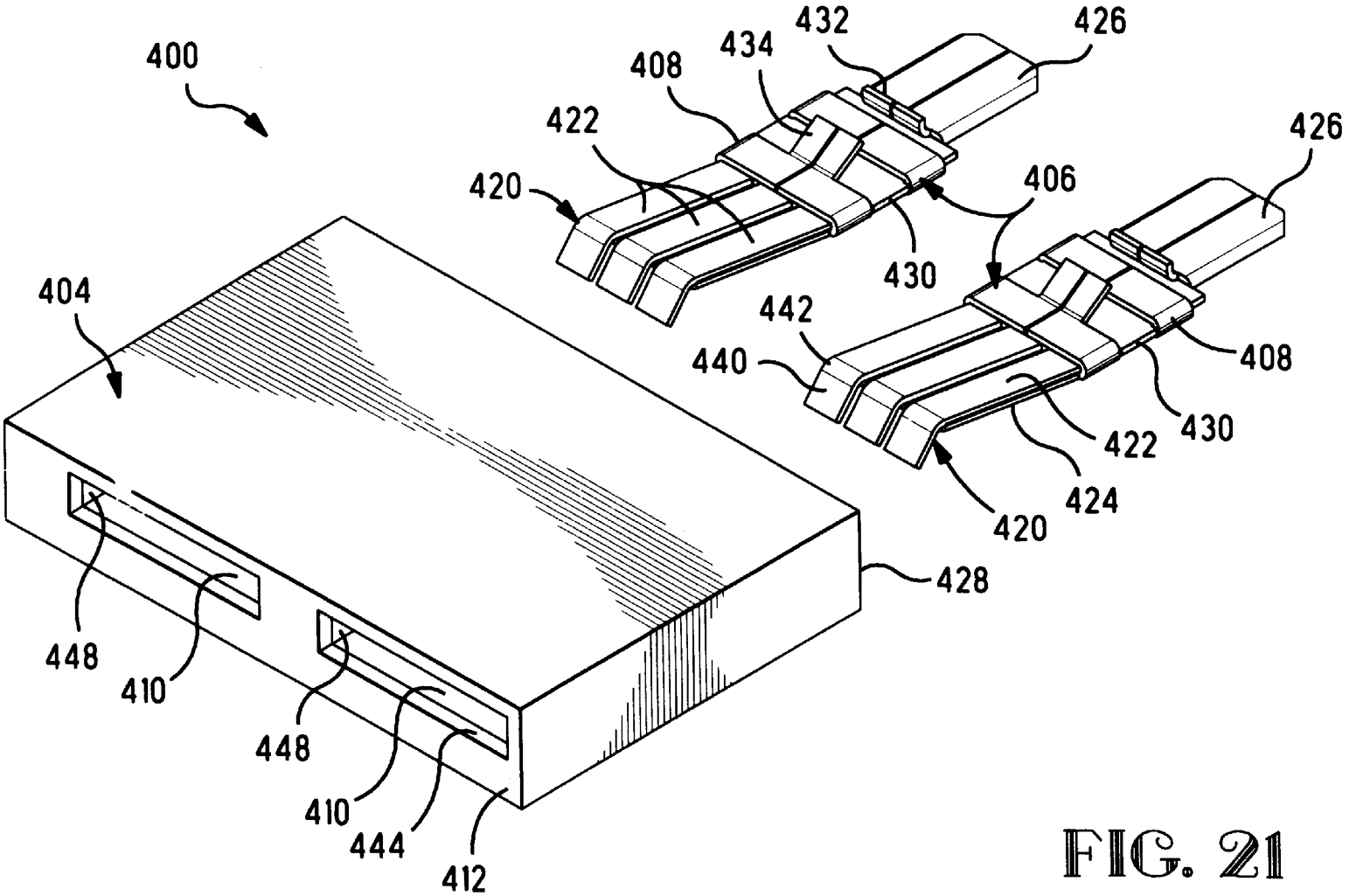
FIG. 21 is an isometric view of a fourth embodiment with a pair of contacts exploded from the connector housing.
Figure 23:
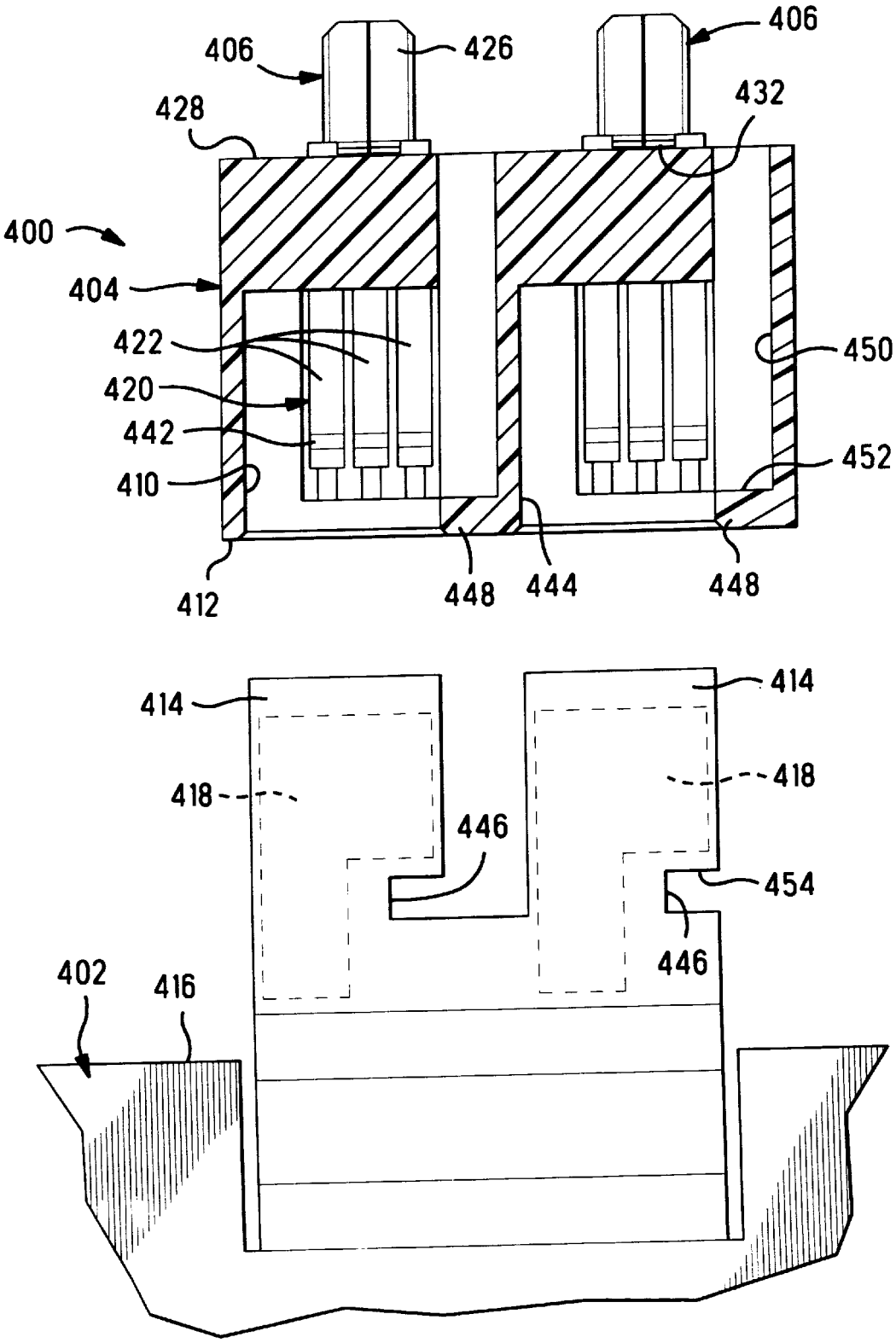
FIG. 23 is a top section view of the connector of FIGS. 21 and 22 positioned to be assembled to a circuit-bearing sheet.
Figure 24:
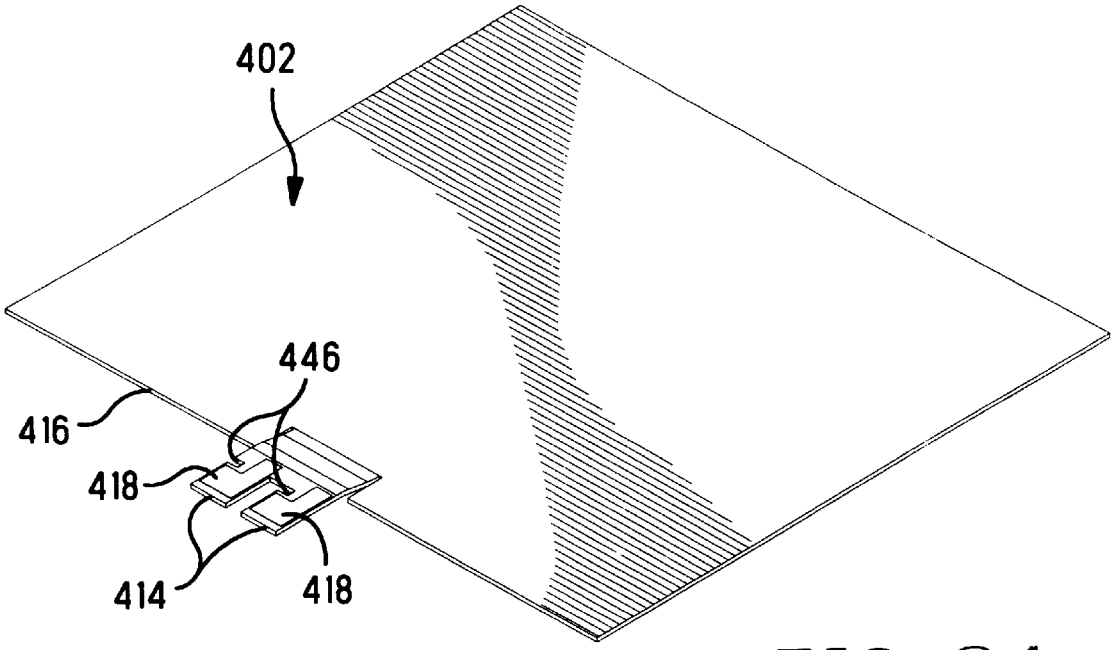
FIG. 24 is an isometric view of a circuit-bearing sheet with which the connector of FIGS. 21 to 23 is to be used.
Figure 25:
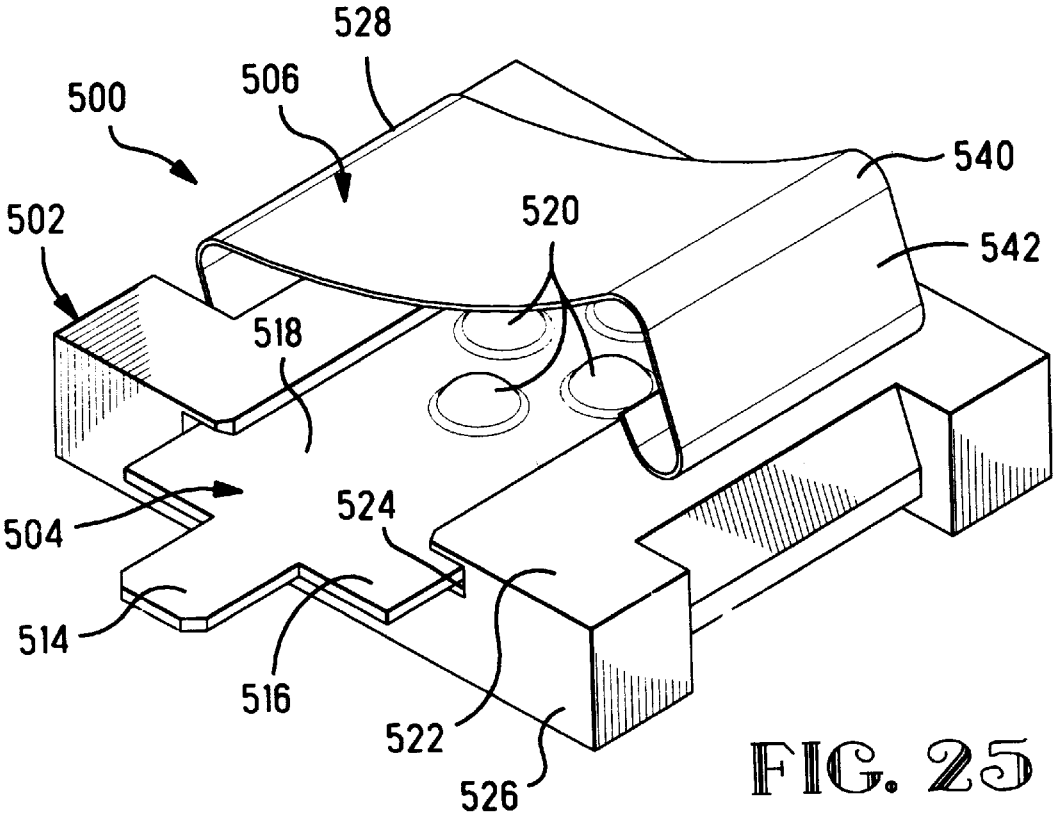
FIGS. 25 and 26 are isometric views of a fifth embodiment of connector of the present invention having a contact to be clamped to a contact pad of a circuit-bearing sheet.
Figure 26:
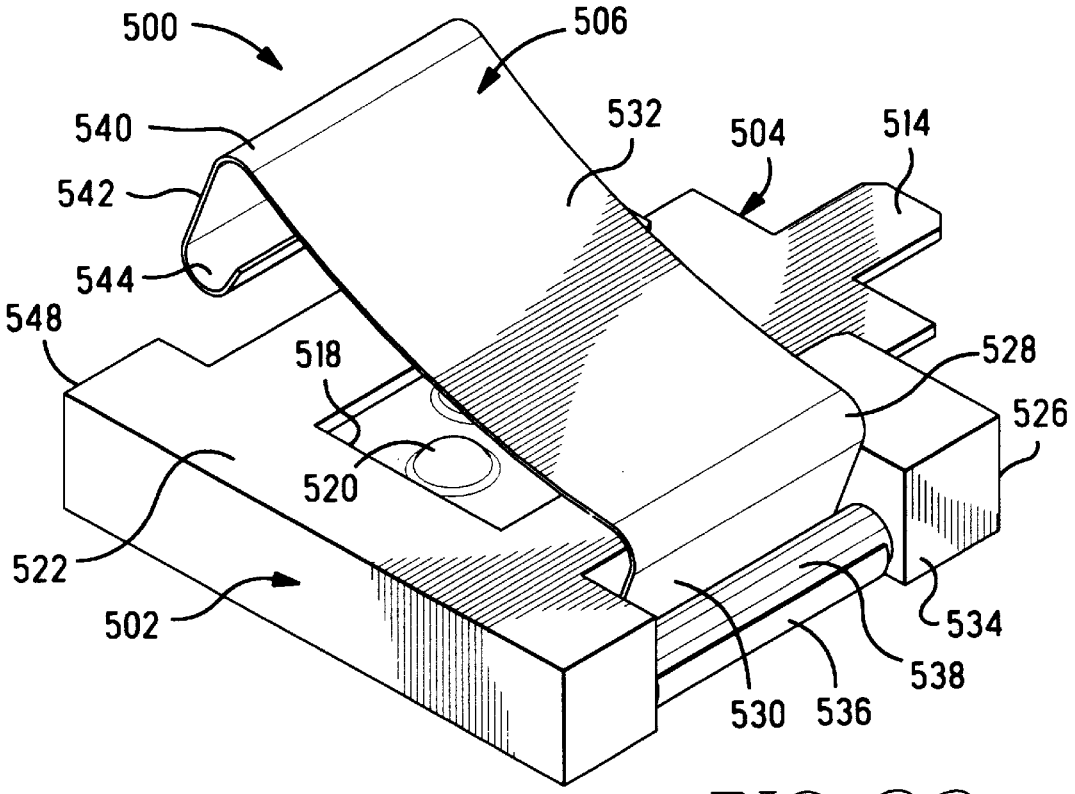
Figure 27:
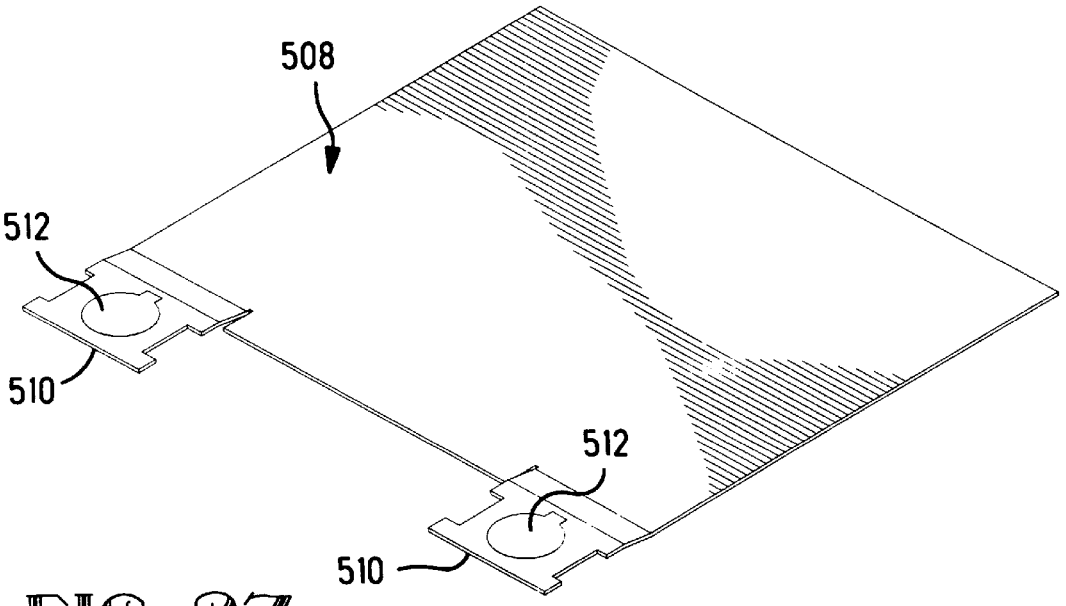
FIG. 27 is an isometric view of a circuit-bearing sheet with which the connector of FIGS. 25 and 26 is to be used.

A fourth embodiment of connector 400 is disclosed in FIGS. 21 to 23 for use with a circuit-bearing substrate 402 shown in FIGS. 23 and 24. As with connector 310 of FIGS. 18 to 20, the connector provides a common housing 404 for two contact members 406, and each contact includes a backup spring 408 such as of stainless steel. Contact members 406 are disposed in respective cavities 410 open along rear face 412 for receipt thereinto of respective tab sections 414 of substrate 402 extending beyond an edge 416 thereof, each having a respective contact pad 418.

First contact sections 420 of contact members 406 are exposed within cavities 410 and include three spring fingers 422 as shown, each supported by a backup spring stiffener 424. Tab-shaped second contact sections 426 extend beyond mating face 428 of connector 400 for electrical engagement with complementary contact sections of a mating connector (not shown). Body section 430 of contact 406 is disposed in a constricted cavity portion, and contact 406 is secured in cavity 410 by tabs 432 extending orthogonally along mating face 428 to stop rearward movement of the contact with respect to the housing, and locking lances 434 extending forwardly to free ends that abut a rearwardly facing ledge 436 defined along cavity 410 to stop forward movement upon contact 406 being fully inserted into cavity 410 from mating face 428. Spring arms 422 are disposed along a recess 438 of cavity 410 parallel to the tab-receiving area, with free ends 440 of spring arms 422 situated in recess 438 and essentially coplanar with body section 430, while apices 442 are disposed in cavity 410 aligned with entrance 444 to be engaged by contact pad 418 of tab 414 of substrate 102 upon mounting of connector 400 thereto, when tabs 414 are inserted into cavities 410.

Tab sections 414 are shown to have notches 446 extending into common sides thereof rearward of contact pads 418. Complementary to notches 446 are protrusions 448 outwardly from cavity side walls of housing 404 extending laterally in a common direction at entrances 444 of cavities 410 along rear face 412, defined by recesses 450 forwardly thereof and in turn defining stop surfaces 452 cooperable with rearwardly facing edges 454 along notches 446 and serving to prevent axial movement of connector 400 after mounting to substrate 402. Once connector 400 has been moved toward substrate 402 so that tabs 414 are received fully into cavities 410 and spring arms 422 are in engagement with contact pads 418 and protrusions 448 are aligned with notches 446, connector 400 is urged laterally with protrusions 448 moving into notches 446 to the final mounted position. Forces of about 200 gms per spring arm, totaling 1200 gms per connector, are sufficient to maintain the connector in position, absent forces applied laterally after installation. Preferably, spring arms 422 are arcuate in cross-section so that at least at apices 442, the engagement surface of the contact spring arm is convex, facilitating lateral movement of the spring arm over the contact pad.

With reference now to FIGS. 25 to 28, a fifth embodiment of connector 500 is disclosed having a housing 502 of dielectric material, a single contact 504 and a clamp 506 of stiffly resilient metal such as stainless steel. A pair of such connectors 500 is used with a circuit-bearing substrate 508 (FIG. 27), each associated with a respective one of tabs 510 and a respective contact pad 512 defined thereon. Contact 504 includes a tab section 514 extending out of the connector and away from substrate 508 for mating with another connector. Body section 516 within housing 502 provides a contact surface 518 similar to that of contact 330 of FIG. 19, having a plurality of embossments 520 that protrude above top housing surface 522 for engagement with the associated contact pad 512 after mounting. Contact 504 is retained in a recessed slot 524 recessed below and in communication with top surface 522 of housing 502 such as by retention barbs or locking lances (not shown) as is conventional, after insertion thereinto from mating face 526, and after mounting to substrate 508, the clamp generates force on contact 504 to enhance the retention in housing 502.

Clamp 506 of connector 500 includes a first securing end 528 having a vertical wall 530 depending from clamp body section 532 along first side wall 534 of housing 502, having a hook section 536 hooked around a pivot rod 538 formed along first side wall 534 permitting rotating of clamp 506 to secure the connector to the substrate. Second end 540 of clamp 506 includes a vertical section 542 also having a hooked end 544 associated with ledge 546 along second side wall 548 of housing 502 for latching thereunder when clamp 506 is urged to its fastened position. Clamp body section 532 is convex toward housing 502 and contact surface 518 of contact 504, such that after latching, clamp 506 applies substantial force on a tab 510 of substrate 508 after connector mounting to generate substantial normal force between contact pad 512 and contact surface 518, thereby establishing an assured electrical connection therebetween, as illustrated in FIG. 28.

Figure 30:
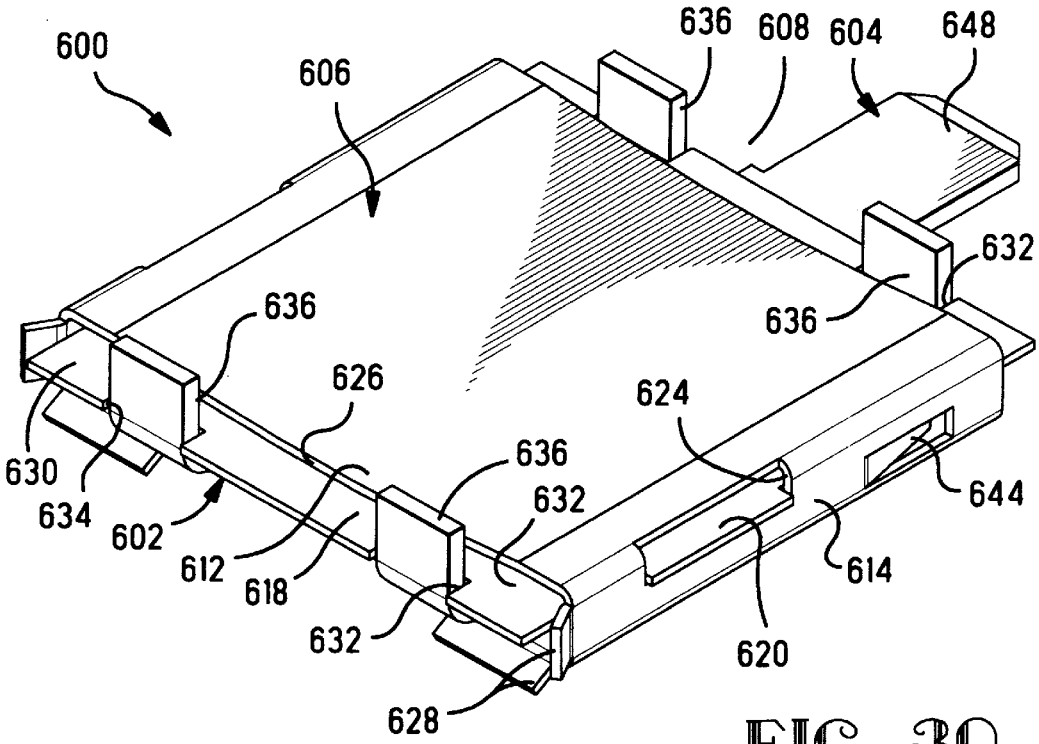
Figure 31:
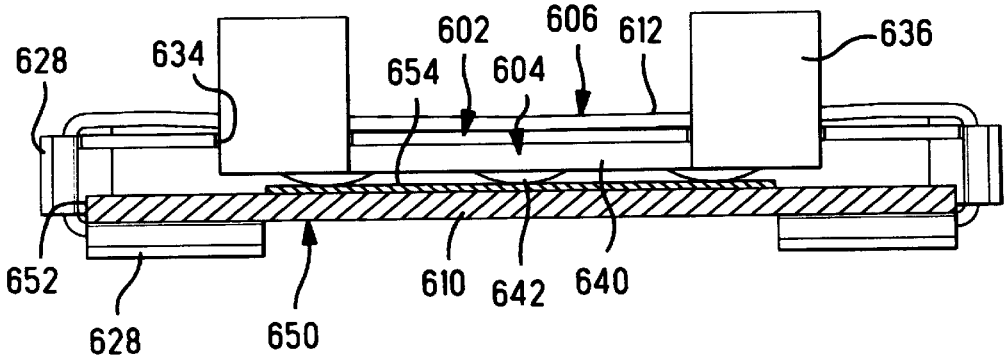
FIG. 31 is an elevation view of the connector of FIGS. 29 and 30.
Figure 32:
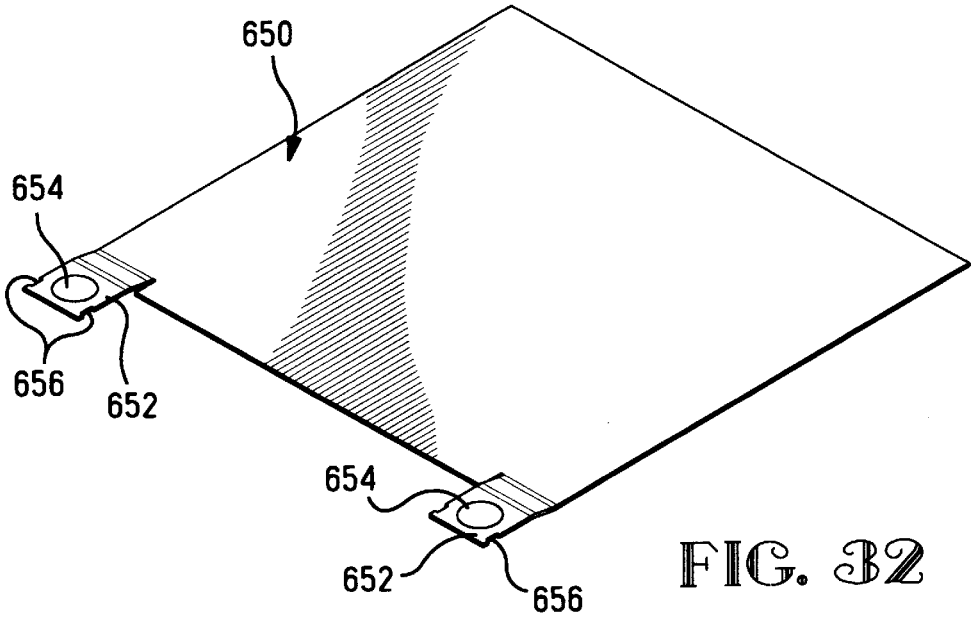
FIG. 32 is an isometric view of a circuit-bearing sheet with which the connector of FIGS. 29 and 30 is to be used.

In FIGS. 29 to 32 is shown a sixth embodiment of connector 600, having a dielectric member 602, a contact 604 and a clamp 606, for use with a substrate 650 having tabs 652 having contact pads 654 thereon (FIG. 32). Dielectric member 602 is generally planar as shown, and is disposed between body section 610 of contact 604 and transverse body section 612 of clamp 606, to insulate the contact from clamp 606 which is preferably of stiff spring metal such as stainless steel. Clamp 606 includes opposed side wall sections 614 that depend from opposed side edges of transverse body section 612 and conclude in inwardly folded bottom wall sections 616 spaced from transverse body section 612 defining a cavity 618 within which are disposed contact member 604 and dielectric member 602. Transverse body section 612 is preferably bowed to be convex toward bottom wall sections 616, thus protruding into cavity 618 prior to mounting onto substrate 650.

Dielectric member 602 includes short tabs 620 that extend from side edges 622 for receipt through slots 624 of side wall sections 614 of clamp 606 to maintain the dielectric member in cavity 618 of clamp 606. Dielectric member 602 is inserted from rear end 626 of clamp 606 facilitated by angled flanges 628 defining a lead-in both during assembly and mounting to substrate 650. Side wall sections 614 of clamp 606 flex slightly outwardly as short tabs 620 are forced therealong prior to seating in slots 624. After assembly, dielectric member 602 is capable of upward movement during insertion of substrate tab 652 into cavity 618, as short tabs 620 ride upwardly in slots 624 that preferably extend to top wall section 612 of clamp 606.

Dielectric member further includes end portions 630 that protrude from opposed ends 632 of cavity 618 and beyond end edges of clamp 606, shown in FIG. 30. Small slots 634 are notched into end portions 630 within which are seated upstanding tabs 636 of contact 604 extending from contact body section 610, serving to hold the contact in cavity 618, with upstanding tabs 636 being spaced from any portion of clamp 606.

Contact surface 640 defined along body section 610 includes embossments 642 extending away from dielectric member 602, for electrical connection with a contact pad 654 on an associated tab 652 of substrate 650 upon insertion of tab 652 into cavity 618, such insertion causing clamp 606 to bow and thereafter generating substantial force clamping tab 652 against contact 604 and an assured electrical connection between contact surface 632 and contact pad 654. Locking lances 644 extend inwardly and away from rearward end 626 of clamp 606, and seat into notches 656 in side edges of tabs 652 of substrate 650, locking connector 600 onto substrate 650.

As can be seen in FIG. 31, tab 652 has been inserted into cavity 618, urging contact 604 and dielectric member 602 upwardly tightly against convex transverse top wall section 612 of clamp 606, whereafter clamp 606 biases downwardly to result in substantial compression of contact 604 against contact pad 654. Contact section 648 extends outwardly from mating face 608 of connector 600 for mating to a complementary connector (not shown).

Figure 33:
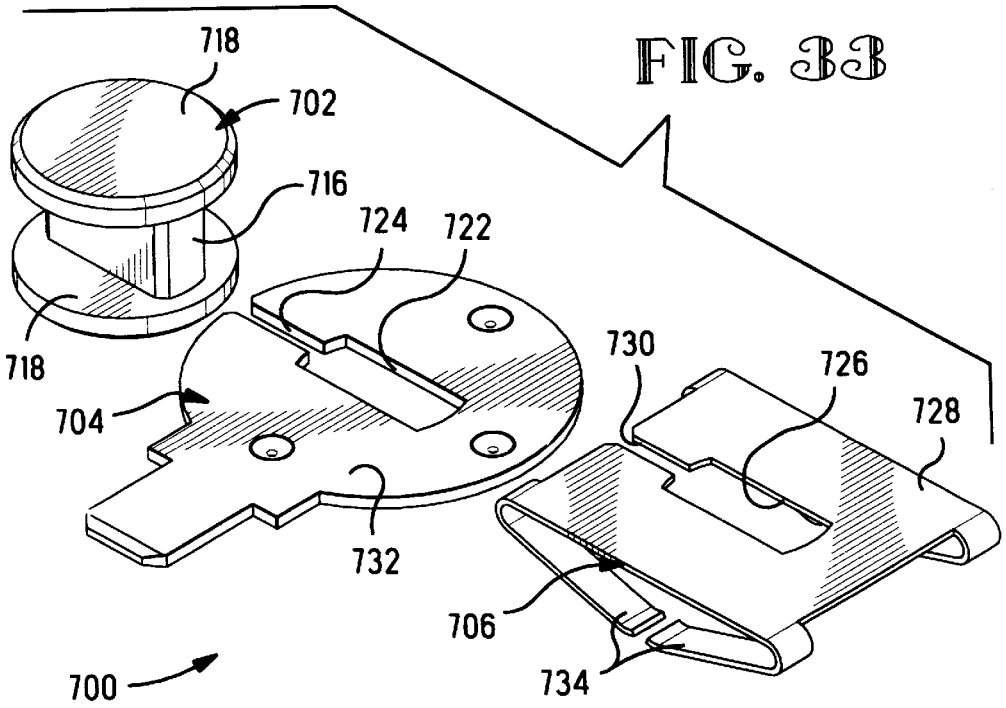
FIGS. 33 and 34 are exploded and isometric views of a seventh embodiment of connector of the present invention.
Figure 34:
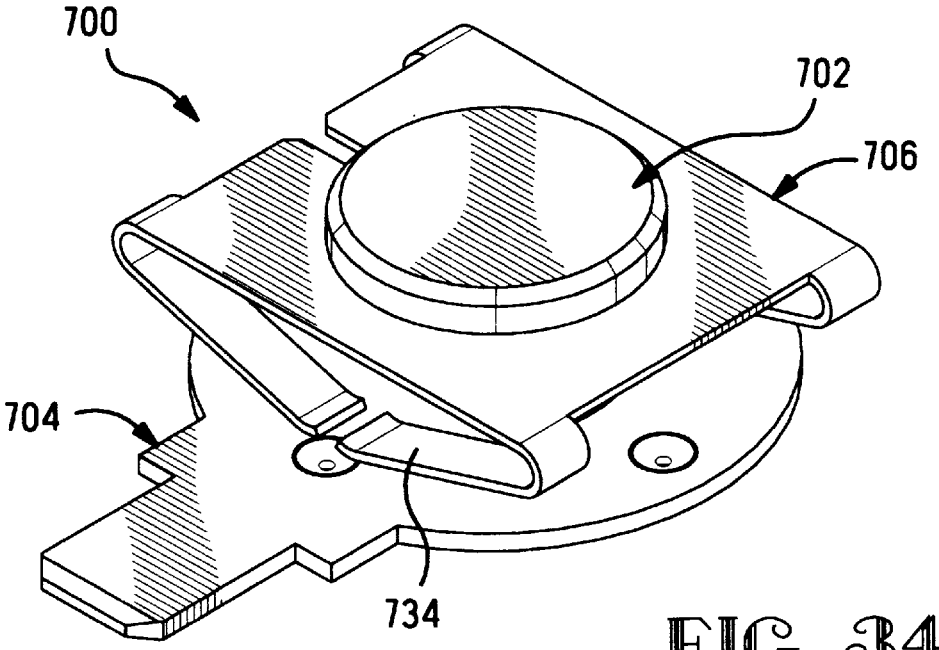
Figure 35:
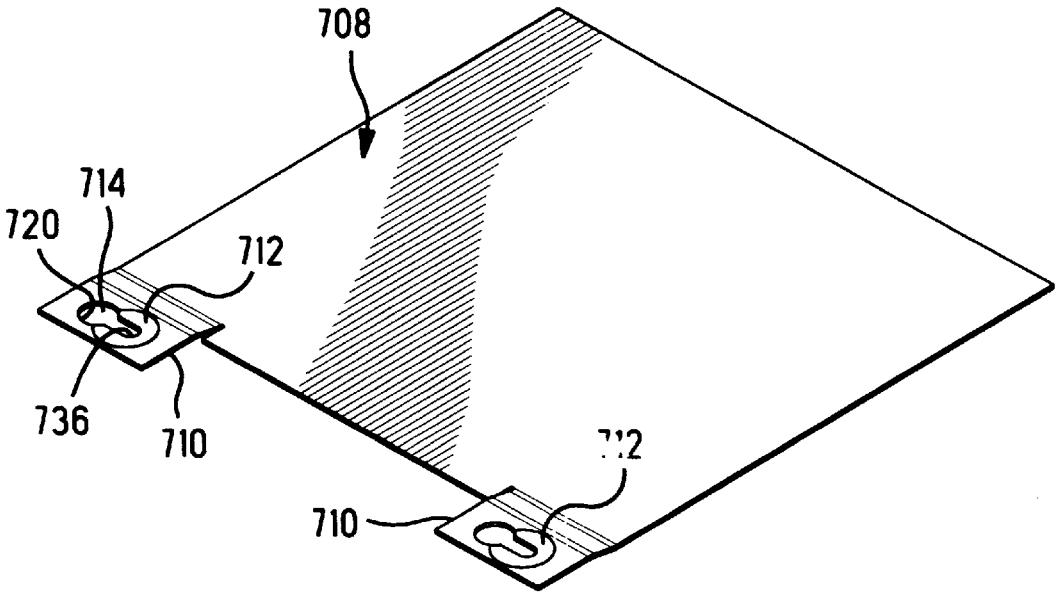
FIG. 35 is an isometric view of a circuit-bearing sheet with which the connector of FIGS. 33 and 34 is to be used.

Now referring to FIGS. 33 to 35, connector 700 includes a dielectric body 702, contact 704 and clamp 706, for use with substrate 708 of FIG. 35 having tabs 710 having contact pads 712 thereon. Each tab 710 includes an aperture 714 therethrough profiled into a keyhole shape. Dielectric body 702 includes a rectangular column section 716 that will extend through aperture 714 upon mounting of connector 700 to substrate 708. Upper and lower head sections 718 are sufficiently widened to secure therebetween the contact 704, clamp 706 and tab 710, but are dimensioned to pass through enlarged end portion 720 of aperture 714.

Column section 716 is fitted into hole 722 of contact 704 through neck 724, and similarly into opening 726 of body section 728 of clamp 706 through neck 730. Clamp 706 is disposed adjacent to contact surface 732 of contact 704 upon assembly of connector 700, with pairs of spring arms 734 biased thereagainst prior to mounting of connector 700 to substrate 708. However, connector 700 may be mounted to tab 710 by first securing clamp 706 beneath the tab and contact 704 above the tab so that contact surface 732 faces downwardly against contact pad 712 with arms 734 engaging the under surface of tab 710, after which connector 700 is urged laterally into narrow portion of aperture 736. Sufficient force is generated by spring arms 734 urging tab 710 toward contact 704 and pressing contact surface 732 and embossments 738 against contact pad 712, to establish an assured electrical connection and also mechanically secure the connector to the substrate.

Figure 36:
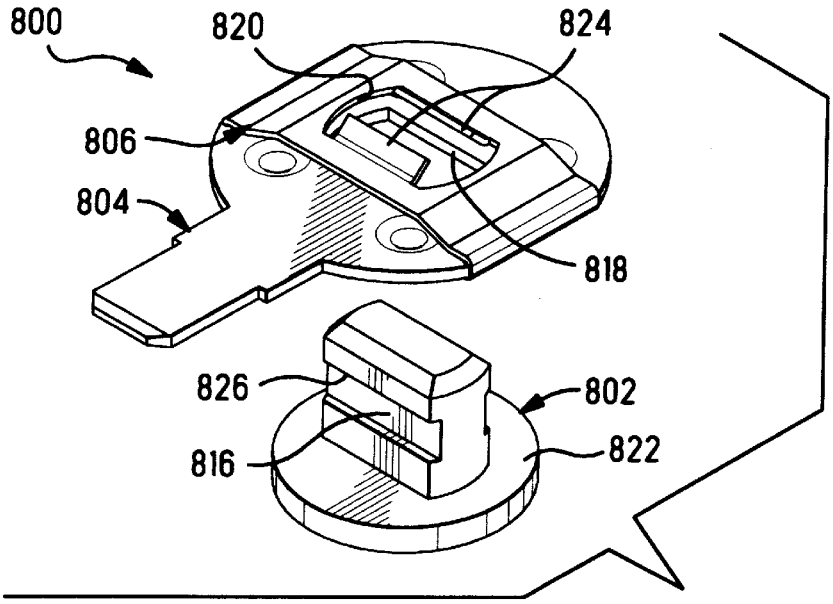
FIG. 36 is an isometric view of an eighth embodiment of connector of the present invention.
Figure 37:
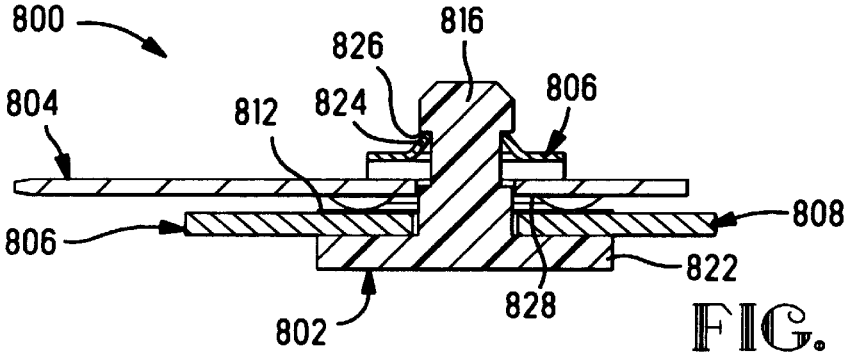
FIG. 37 is a cross-sectional view of the connector of FIG. 36 clamped to a circuit-bearing substrate.
Figure 38:
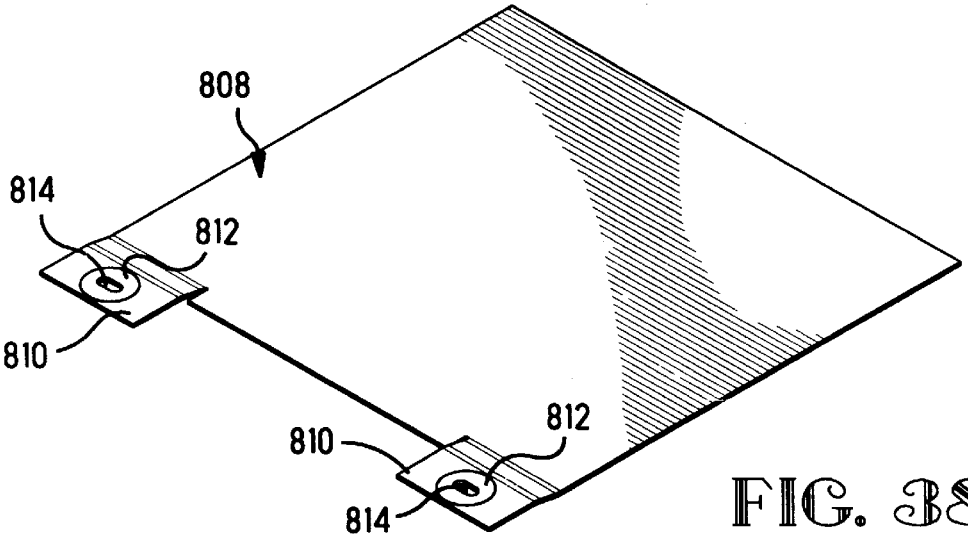
FIG. 38 is an isometric view of a circuit-bearing sheet with which the connector of FIGS. 36 and 37 is to be used.
Figure 39:
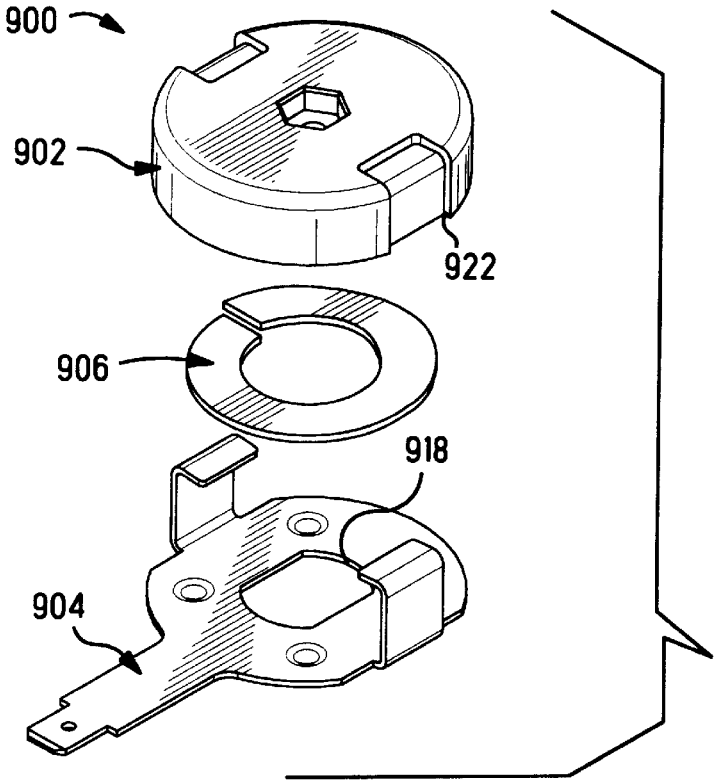
FIGS. 39 and 40 are exploded isometric views of a ninth embodiment of connector of the present invention, from above and below thereof.
Figure 40:
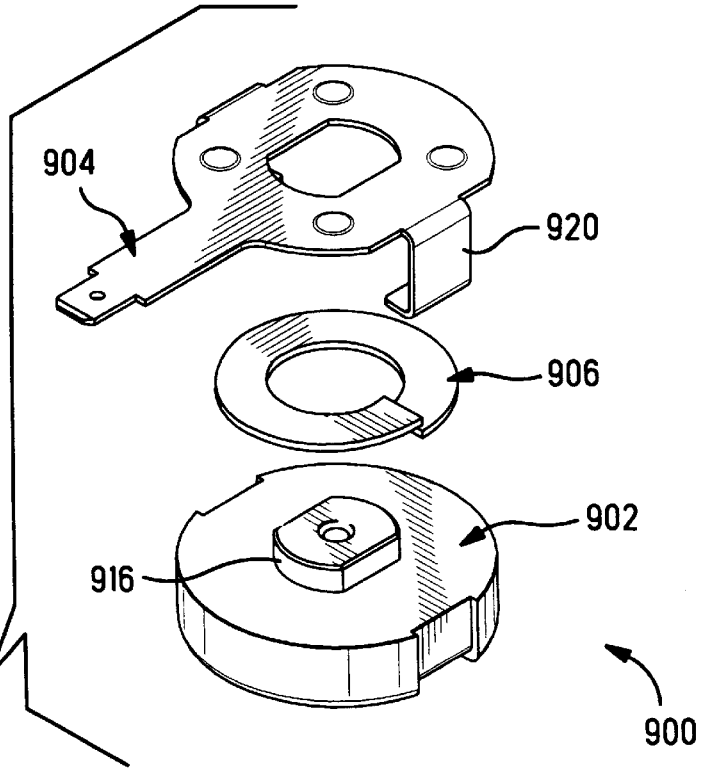
Figure 41:
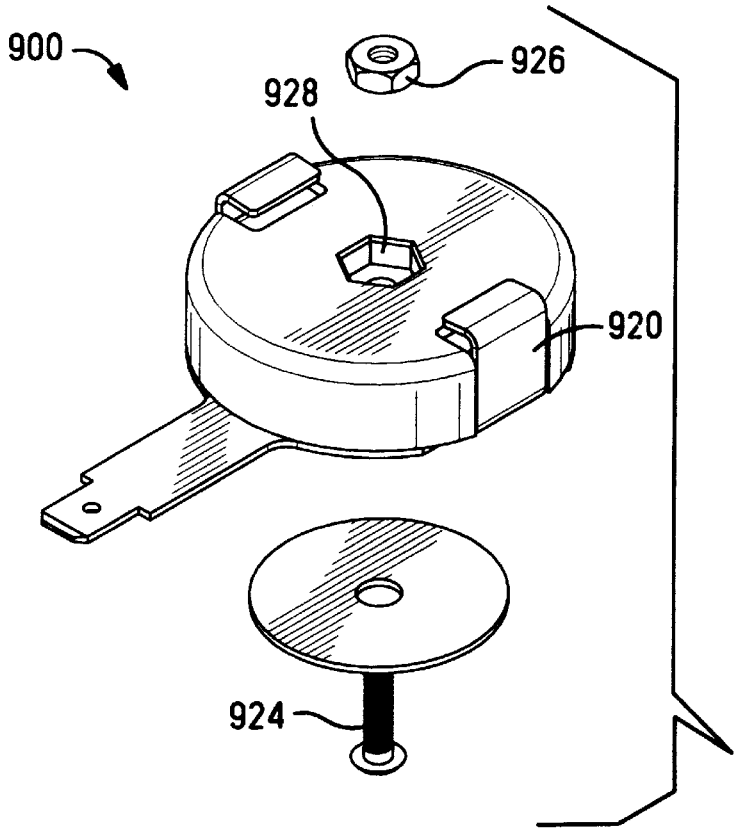
FIG. 41 is an isometric view of the assembled connector of FIGS. 39 and 40 with fastening hardware exploded therefrom.
Figure 42:
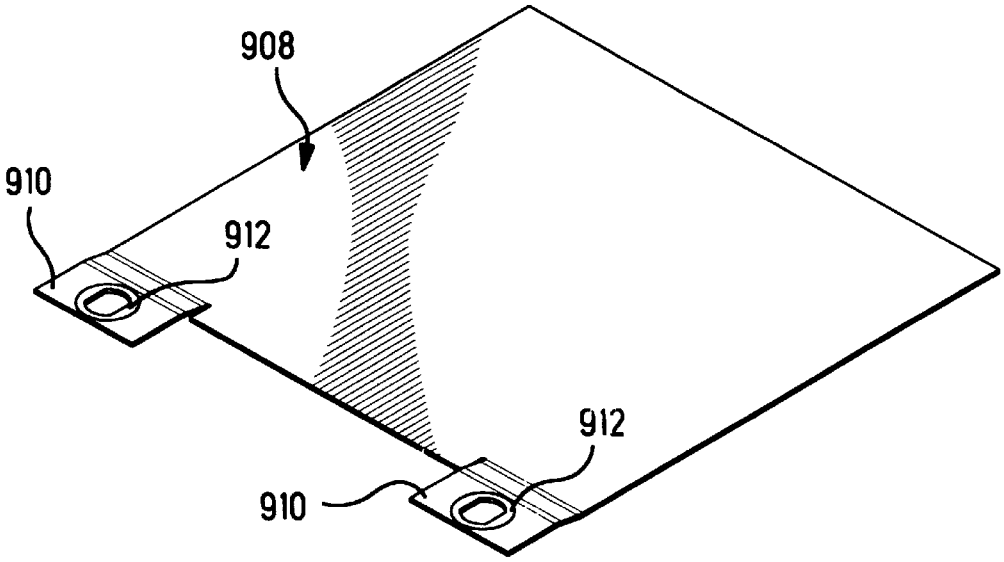
FIG. 42 is an isometric view of a circuit-bearing sheet with which the connector of FIGS. 39 to 41 is to be used.

In FIGS. 36 to 38, connector 800 includes a dielectric body 802, contact 804 and clamp 806, for use with substrate 808 of FIG. 38 having tabs 810, contact pads 812 thereon and apertures 814 therethrough. Dielectric body 802 includes a column section 816 dimensioned for passing through aperture 814 of tab 810, hole 818 of contact 804 and opening 820 of clamp 806. Enlarged head 822 will be disposed against the bottom of a tab 810 upon mounting. Clamp 806, preferably of stainless steel, includes outwardly turned flanges 824 adjacent opening 820 that lock into position against ledges 826 defined into column section 816 near the end thereof, upon mounting to tab 810 as seen in FIG. 37, generating substantial force pressing contact surface 828 of contact 804 against contact pad 812 of tab 810.

FIGS. 39 to 42 illustrate another embodiment of connector 900 having a dielectric body 902, contact 904 and stainless steel lock washer 906, for use with substrate 908 (FIG. 42) having tabs 910, contact pads 912 and shaped apertures 914 extending therethrough. Low height column section 916 of dielectric body 902 seats in shaped aperture 914, and extends through lock washer 906 and hole 918 of contact 904. Contact 904 includes a pair of straps 920 that latch around dielectric body 902 and seat in recesses 922 thereof to hold the contact in position. Mounting is accomplished by a bolt 924 that extends through central opening 928 through washer 925, substrate aperture 914, and dielectric body 902 and is secured by nut 926, generating substantial force to establish an assured electrical connection between contact pad 912 of tab 910 and contact surface 930 of contact 904.

Although the inventive connector is especially useful for a thin ceramic-coated metal plate, the connector may be used with other substrates such as circuit boards.

What is claimed is:

1. A connector for mounting to a circuit-bearing substrate, comprising:

a housing of dielectric material, the housing including at least one slot;

at least one contact, each contact insertable into a respective slot from an assembly face of the housing, each contact including a locking lance that locks behind a ledge defined along the slot, parallel to a plane of the assembly face, each contact having first and second contact sections;

a fastening means for securing said housing to said substrate; and a spring section;

portions of at least one of said fastening means and said housing extending through at least one opening in said substrate, and a transverse body section of at least said housing extending along a respective surface of said substrate adjacent said at least one opening, said first contact section of each said at least one contact being exposed adjacent said substrate to engage a circuit pad of said substrate defined thereat, and said second contact section extending outwardly from said housing for becoming electrically connected with a complementary contact upon being mated therewith; and said spring section applying spring bias to press said substrate against said first contact section of each said at least one contact and thereby electrically connect said circuit pad and said at least one contact.

2. A connector as set forth in claim 1 wherein said first contact section includes a plurality of embossments protruding therefrom toward said circuit pad to provide a plurality of distinct electrical connection locations.

3. A connector as set forth in claim 1 wherein said housing includes at least one protrusion extending laterally from a side wall of at least one of said cavities to be received into a corresponding notch along a side edge of a said portion of said tab upon full insertion of said tab into said housing, to secure said housing in position along said substrate tab against movement in a direction parallel to insertion of said substrate tab.

4. A connector as set forth in claim 3 wherein said housing includes flanges extending forwardly from a mating face and along said substrate-proximate surface to separate said substrate from said second contact sections of said contacts extending from said mating face.

5. A connector as set forth in claim 4 wherein an upstanding boss extends from an end of one of said forwardly extending flanges transverse to said tab-receiving channel to define a positive stop for said substrate tab during assembly.

6. A connector as set forth in claim 1 for a single tab of said substrate having opposed side edges and a pair of circuit pads defined on a first surface thereof, wherein:

said housing includes a pair of contact-receiving slots extending thereinto from an assembly face for respective said contacts to be inserted thereinto from said assembly face, said slots being in communication with a substrate-proximate surface of said transverse housing body section exposing said first contact sections of said contacts therealong; and said fastening means being a clamp having a transverse body section comprising said spring section, and a pair of legs extending orthogonally from ends of said transverse clamp body section to extend past said side edges of said substrate tab and said housing to secure to said housing, with said transverse clamp body section opposing said transverse housing body section to define a tab-receiving channel therebetween, said clamp being secured to said housing by a first securing section when in a first position to define said tab-receiving channel, said clamp being movable to a second position with respect to said housing and securable by a second securing section to terminate said at least one contact to a respective circuit of said substrate, whereby said clamp in said first position defines a substrate-receiving gap between said substrate-proximate surface of said housing and said transverse body section of said clamp, and in said second position engages said second surface of said substrate tab by said transverse clamp body section to press said substrate against said first contact sections of said contacts to establish an electrical connection between said contacts and respective said circuit pads.

7. A connector as set forth in claim 6 wherein said transverse clamp body section is arcuate and is convex to extend into said tab-receiving channel, and to be pressed against said substrate tab when said clamp is moved from said first position to said second position, thereafter applying spring pressure to urge said substrate tab against said first contact sections.

8. A connector as set forth in claim 6 wherein a body section of each said contact is U-shaped in cross-section having a horizontal body section, a side wall and a horizontal first contact section opposed to said horizontal body section, and each said contact-receiving slot includes a horizontal slot portion in communication with a vertical slot portion that in turn is in communication with a recess along said substrate-proximate surface, associated respectively with said horizontal body section, said side wall and said first contact section to permit insertion of said contact into said housing with said first contact section disposed in said recess.

9. A connector as set forth in claim 6 wherein said first and second securing sections comprise notches in said legs of said clamp into which seat first and second locking projections along said ends of said housing.

10. A connector as set forth in claim 9 wherein said clamp and said housing comprise a unit adapted to be handled for placement onto said substrate tab, when said clamp is in said first position defining said tab-receiving channel.

11. A connector as set forth in claim 9 wherein said first and second locking projections are defined along legs of a bracket extending about said housing opposed from said substrate-proximate surface and said clamp.

12. A connector as set forth in claim 11 wherein said clamp, said housing and said bracket comprise a unit adapted to be handled for placement onto said substrate tab, when said clamp is in said first position defining said tab-receiving channel.

13. A connector as set forth in claim 12 wherein said bracket legs include locking lances that lock into grooves along said ends of said housing to secure to said housing.

14. A connector as set forth in claim 12 wherein said housing includes a ledge extending rearwardly from a tab-receiving face thereof and along said substrate-proximate surface to separate said substrate from a rear wall of said bracket, and further includes a lip along an opposed mating face of said housing to separate said second contact portions from front portions of said bracket.

15. A connector as set forth in claim 12 wherein said housing includes a pair of flanges upstanding from said substrate-proximate surface and into said tab-receiving channel to seat into corresponding notches along said side edges of said substrate tab upon assembly thereto, to secure said connector against movement after said clamp is moved to said second position.

16. A connector as set forth in claim 15 wherein said flanges differ from each other and said notches differ from each other and are complementary to said flanges, for polarization.

17. A connector for mounting to a circuit-bearing substrate, comprising:

a housing of dielectric material, at least one contact secured thereto having first and second contact sections, a fastening means for securing said housing to said substrate, and a spring section;

portions of at least one of said fastening means and said housing extending through at least one opening in said substrate, and a transverse body section of at least said housing extending along a respective surface of said substrate adjacent said at least one opening, said first contact section of each said at least one contact being exposed adjacent said substrate to engage a circuit pad of said substrate defined thereat, and said second contact section extending from said housing for becoming electrically connected with a complementary contact;

each said first contact section including a plurality of embossments protruding therefrom toward said circuit pad to provide a plurality of distinct electrical connection locations; and said spring section applying spring bias to press said substrate against said first contact section of each said at least one contact and thereby electrically connect said circuit pad and said at least one contact.

18. The connector of claim 17 wherein each said first contact section includes a plurality of spring arms, each providing one of said plurality of distinct electrical connection locations.

* * * * *